US008387435B2

(12) United States Patent
Bandou et al.

(10) Patent No.: US 8,387,435 B2
(45) Date of Patent: Mar. 5, 2013

(54) ELBOW MATERIAL PRODUCTION DEVICE AND PRODUCTION METHOD THEREOF

(75) Inventors: Takeyasu Bandou, Tokyo (JP); Shinji Fukaya, Tokyo (JP); Hisashi Shirayama, Tokyo (JP); Hideichi Tsuboi, Tokyo (JP)

(73) Assignee: Ihara Science Corporation, Tokyo (JP)

( * ) Notice: Subject to any disclaimer, the term of this patent is extended or adjusted under 35 U.S.C. 154(b) by 818 days.

(21) Appl. No.: 12/517,881

(22) PCT Filed: Dec. 6, 2007

(86) PCT No.: PCT/JP2007/073583

§ 371 (c)(1),
(2), (4) Date: Oct. 8, 2009

(87) PCT Pub. No.: WO2008/069269

PCT Pub. Date: Jun. 12, 2008

(65) Prior Publication Data

US 2010/0294388 A1 Nov. 25, 2010

(30) Foreign Application Priority Data

Dec. 6, 2006 (JP) ..... 2006-357107
Apr. 2, 2007 (JP) ..... 2007-120119
Oct. 19, 2007 (JP) ..... 2007-271961

(51) Int. Cl.
*B21D 7/06* (2006.01)

(52) U.S. Cl. ..... 72/389.8; 72/369; 72/383; 72/387; 29/890.149

(58) Field of Classification Search ..... 72/369, 72/383, 386, 387, 389.8; 29/890.149
See application file for complete search history.

(56) References Cited

U.S. PATENT DOCUMENTS 3,869,776 A * 3/1975 Moshnin et al. ..... 29/890.149
4,003,210 A * 1/1977 Bostroem ..... 405/184.5

(Continued)

FOREIGN PATENT DOCUMENTS

CN 1375363 10/2003
JP 49-129666 12/1974

(Continued)

OTHER PUBLICATIONS

Search Report of International Application No. PCT/JP2007/073583.

(Continued)

*Primary Examiner* — David B Jones
(74) *Attorney, Agent, or Firm* — DLA Piper LLP (US)

(57) ABSTRACT

A method and a device for bending a metal hollow thick walled member to a predetermined angle without deviation of the bending center position and without separation from a half die when presser die moves up. With a pair of guide plates (GP1 and GP2) turnably attached to a center pin CP kept horizontal and the axis center of the center pin intersecting with the axis center of the metal hollow thick walled member PM, the member PM is mounted on a half die (82*a*). When die holding members (80*a* and 80*b*) fixedly connected to the above guide plates and kept horizontal are inclined and separated from each other as the center pin lowers, the member PM is bent to the predetermined angle and held on the half die (82*b*). When the center pin that can be moved vertically by a guide member moves down to a predetermined position, a contact portion (96*b*) contacts the inclined surface of a stopper (92*b*) to allow a base plate (16) to receive a pressing force from an upper die via the stopper.

13 Claims, 22 Drawing Sheets

U.S. PATENT DOCUMENTS

| | | | | |
|---|---|---|---|---|
| 6,450,001 | B1 * | 9/2002 | Kimura | 72/389.8 |
| 6,715,334 | B2 * | 4/2004 | Kimura et al. | 72/389.8 |
| 7,140,225 | B2 * | 11/2006 | Takahashi et al. | 72/369 |
| 2002/0129636 | A1 | 9/2002 | Kimura et al. | |
| 2005/0172692 | A1 | 8/2005 | Takahashi et al. | |

FOREIGN PATENT DOCUMENTS

| | | |
|---|---|---|
| JP | 50-102562 | 8/1975 |
| JP | 52-54664 | 5/1977 |
| JP | 154341/1979 | 10/1979 |
| JP | 62-179820 | 8/1987 |
| JP | 2002-273522 | 9/2002 |
| JP | 2005-219110 | 8/2005 |

OTHER PUBLICATIONS

English abstract of JP-62-179820.
English abstract of JP-2005-219110.
Machine English language translation of JP-2005-219110.
English abstract of JP-2002-273522.
Machine English language translation of JP-2002-273522.

* cited by examiner

Fig. 6 A
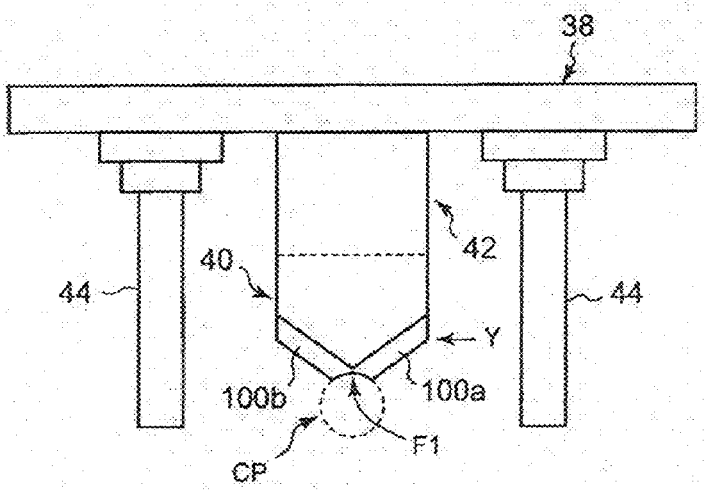
(a)
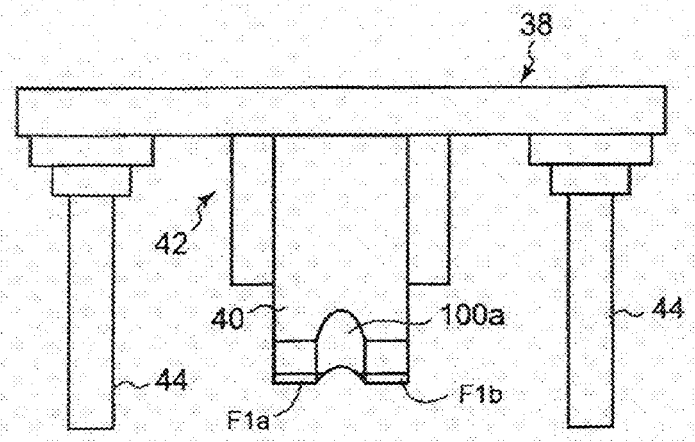
(b)

Fig. 6 B
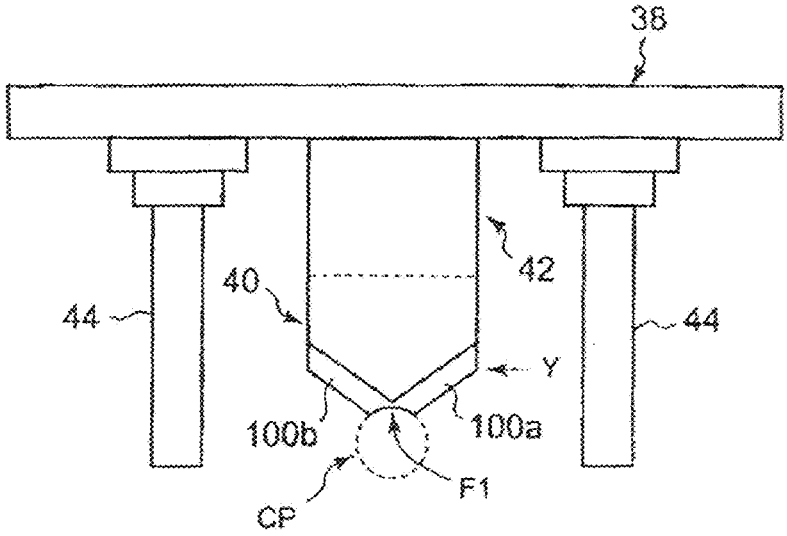
(a)
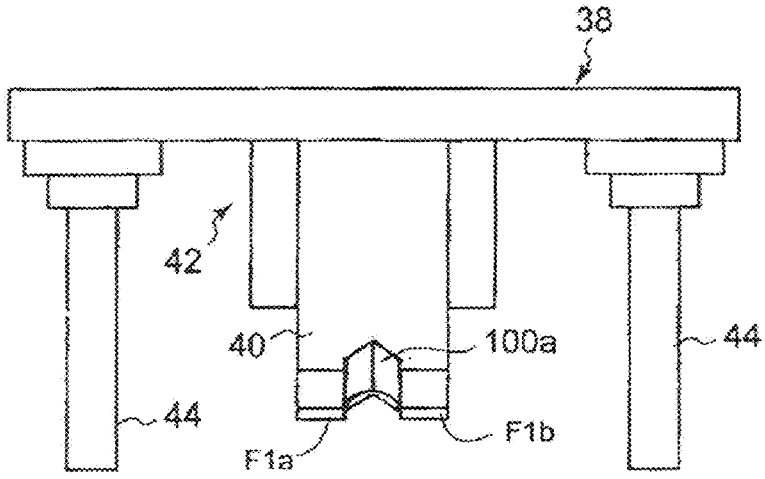
(b)

Fig. 1 0 B
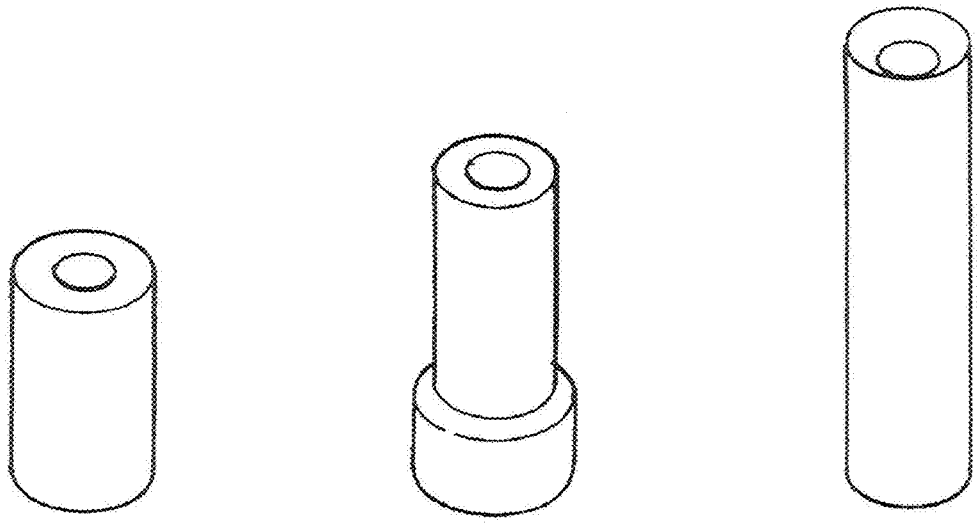

Fig. 1 1 B
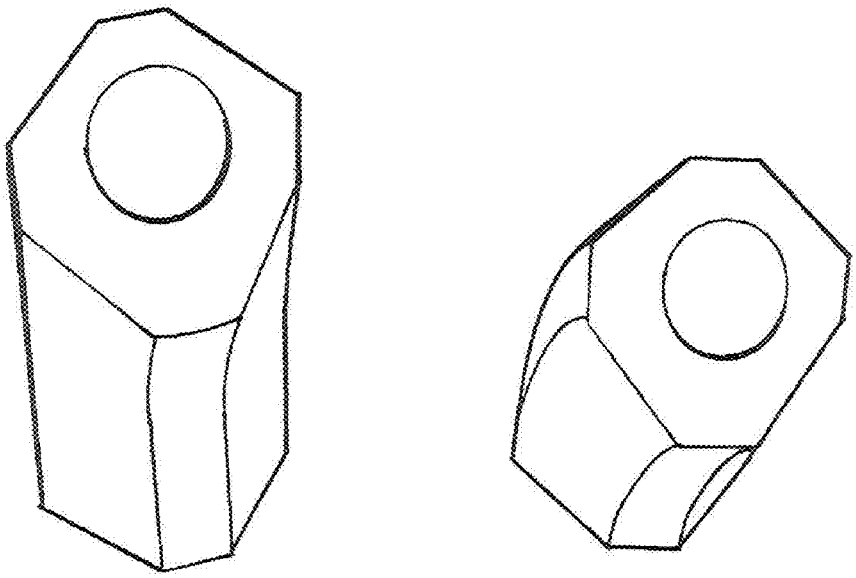

Fig. 1 2 B
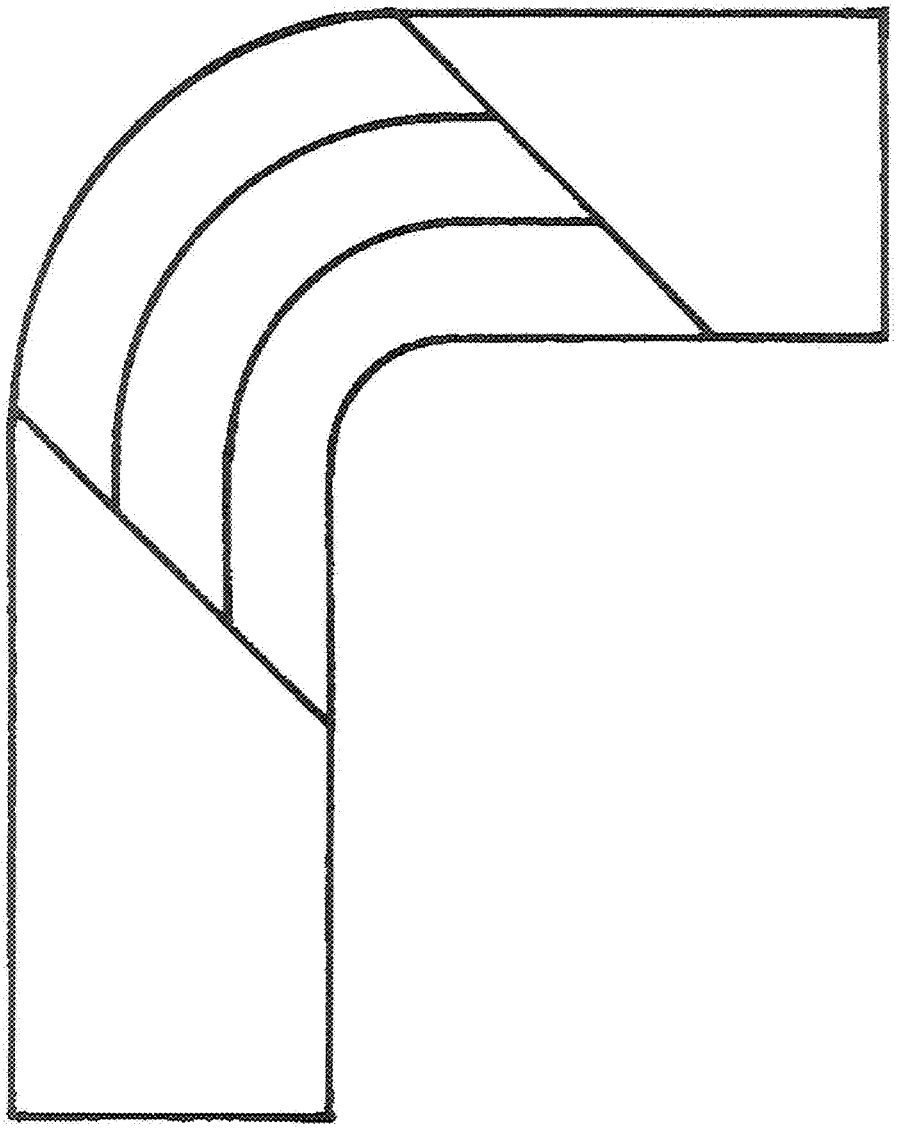

Fig. 1 3 A
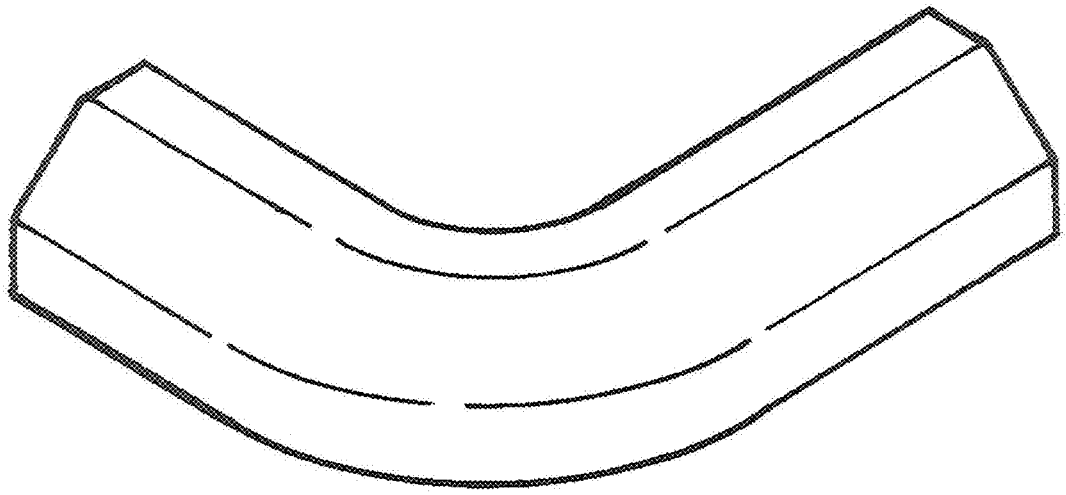

ELBOW MATERIAL PRODUCTION DEVICE AND PRODUCTION METHOD THEREOF

FIELD OF THE INVENTION

The present invention relates to producing an elbow material, and more specifically relates to the elbow material, and a production device and a production method thereof, wherein the elbow material, is formed by bending to a predetermined angle a metal hollow thick walled member of a given length having a hollow passage of an approximately circular section along an axial direction of the member with both ends opened, and approximately circular or at least one pair of parallel surfaces in the periphery of the member.

BACKGROUND OF THE INVENTION

In general, pipe lines for transporting fluid there through are connected at given positions in the lines by the use of pipe fittings. In such case, elbows are used as the pipe fittings for changing the direction of the pipe lines.

Conventionally, because a solid core forged member is used as the elbow material, drilling works are necessary to form a fluid passage inside from both end surfaces to a center portion inside the member.

However, as the result of such drilling works from each end side to the center portion, there is a problem that a crossing portion is formed, in which fluid resistance becomes large in view of lack of smoothness of the fluid passage.

In addition, there is another problem that the manufacturing cost rises up because it is necessary to do cutting operation such as rough and finish drilling works for the fluid passage and to dispose the chip.

On the other hand, it is disclosed in the patent literature 1 that pipe members such as a rear stay of the motor cycle are bent by pressing, though the rear stay itself is different from the elbow mentioned above.

As shown in FIG. 3 of the patent literature 1, there is provided with a pair of dies turnably supported by a pair of support axes which are parallel each other. A pipe is mounted on them in the direction of crossing with the support axes. Both ends of the pipe are held tight between a stopper mounted on the one die and a press cylinder mounted on the other die. It is characterized in that a punch is pushed down onto the pipe portion between the dies, while exerting compression forces in the longitudinal direction to the pipe by means of the cylinder.

In addition, as a solution to the above disadvantages, a method and an apparatus for manufacturing elbow material having a thick walled bent pipe described in the patent literature 2 is proposed.

In the patent literature 2, as the prior art the apparatus includes an upper die 210 having a presser die 212 and an upper guide 211 having a guide surface 211*a* in a circular arc form for guiding a pair of lower dies 221 and 222, as shown in FIG. 10. The apparatus also includes a pair of lower dies 221 and 222 having sliding plane 220*c* and 220*c* in a circular arc form, and a lower guide 230 having sliding planes 230*a* and 230*a* for mounting a pair of the lower dies 221 and 222 thereon. In connection with a descent of the upper die 210, the sliding planes 220*c* and 220*c* in the circular arc form of a pair of lower dies 221 and 222 abut to and slide along the guide surface 211*a* in the circular arc form of the upper guide 211 of the upper die 210. At the same time as this, lower end portions 220*f* and 220*f* of a pair of the lower dies 221 and 221 abut to and slide along the sliding planes 230*a* and 230*a* of the lower guide 230. Sliding in this manner makes the structure in which a pair of the blower dies 221 and 222 are respectively rotatable opposite to each other.

According to this apparatus, a pair of the lower dies 221 and 222 rotates along the guide surface 211*a* in the circular arc form of the upper die 210, having a center of rotation O1 while they are facing to each other. Thereby, changes in the distances between both the end surfaces of the thick-walled pipe material 111*a* and the center O1 of rotation at the start of bending and at the completion of bending are reduced, thus making it possible to form a thick walled elbow material that is a thick-walled bent pipe with less variation in size.

As a result, the thick walled pipe can be cut and used as an elbow material, thus making it unnecessary to prepare a forged material. Further, since a thick walled pipe can be used, drilling for making slender holes to form fluid passages is unnecessary. Further, deburring at the crossing portion of the drilled holes, which is conventionally performed, is made unnecessary.

Furthermore, since the thick walled pipe is round in the outer shape, the margin to cut for screw thread cutting is reduced. Accordingly, a special drill is not needed, drilling work and deburring work are not needed, and cutting amount for screw threading work is reduced, whereby the time required for work, and tool cost can be substantially reduced, and the yield of the material can be improved.

However, since the upper guide 211 of this apparatus has the guide surface 211*a* in the circular arc form, the guide surface 211*a* in the circular arc form has to be worked by cutting a block to produce the upper guide 211, which requires a large amount of work and makes the work complicated, and as a result, work cost becomes high. Since the upper guide 211 is in a block form, it has heavy weight, which is inconvenient in handling. Further, the sliding surfaces 220*c* and 220*c* in the circular arc form of a pair of the lower dies 221 and 222 abut to and slide along the guide surfaces 211*a* in the circular arc form of the upper guide 211 of the upper die 210, and thus the sliding surfaces 220*c* and 220*c* and the guide surfaces 211*a* in the circular form are worn or seized if they are used for a long period of time.

In order to solve such problems, as shown in FIGS. 1 to 8 of the patent literature 2 discloses an apparatus for manufacturing a thick walled bent pipe comprising: a presser die; a lower die movably attached to a stationary portion of the apparatus, the lower die including a pair of bottom dies having means for meshing with means to be meshed which is secured to the stationary portion of the apparatus and biasing means for pressing the pair of bottom dies upward by a resilient force such as a spring force or the like; wherein, at the time of formation, the pair of the bottom dies are caused to rotate opposite to each other about a single center point from an initial position as the means for meshing meshes with the means to be meshed, with a descent of the presser die to perform the formation and, after the formation is finished, the pair of bottom dies are pressed upward by the biasing means and caused to rotate opposite to each other about the single center point as the means for meshing meshes with the means to be meshed, with an ascent of said pressure die, to thereby return to the initial position.

Also, the Patent literature 2 discloses a method for manufacturing a thick walled bent pipe using the apparatus, comprising the steps of placing a thick walled metal pipe material of a predetermined length on a lower die comprising a pair of bottom dies moveably attached to a stationary portion of a bending apparatus, said pair of bottom dies having means for meshing with means to be meshed that is secured to said stationary portion of said bending apparatus; pressing a middle portion in a longitudinal direction of said thick walled metal pipe material by lowering a presser die, and thereby rotating the pair of said bottom dies opposite to each other about a single center point from an initial position as the means for meshing meshes with the means to be meshed, to form a thick-walled elbow material of a predetermine size; and after the formation is finished, pressing the pair of bottom dies upward by biasing means to cause the pair of bottom dies to rotate opposite to each other about the single center point as the means for meshing meshes with the means to be meshed, to thereby return the pair of bottom dies to the initial position.

Patent literature 1: Official gazette of Japanese patent published (unexamined) No. 50-102562

Patent literature 2: Official gazette of Japanese patent No. 3544183

Problem to be Solved by the Invention

There are following disadvantages in case that the apparatus disclosed in the patent literature 1 is applied to manufacture the elbow material.

Namely, in the patent literature 1, it is necessary to substantially increase rigidity of the support axes 5, 6 because the force necessary to push down the punch 10 onto the pipe portion becomes much more than the rear tray in bending formation of the elbow material from the pipe 9 with relatively thick walled metal pipe under the room temperature.

In addition, the bending stress is concentrated in the central portion of the curvature radius R because the central portion of the pipe 9 is directly pushed down by means of the lower end side of the punch 10. Accordingly, it is difficult to easily define the pushing pressure value that requires various experimental tests while taking into account of the sectional shapes and quality of the material of the pipe.

On the other hand, in the patent literature 2 there are provided with the linear racks 35*a* having the guide surfaces 31*a*, 31*a* of a pair of guide blocks 31, 31 and the fan like circular arc racks 25*a*, 25*a* meshing with the linear racks, which are formed on the bottom dies 21, 22.

Accordingly, geometrically in accordance with the downward movement of the presser die 12, the point of intersection OE1, namely, the bending center of the pipe material 111*a*, corresponding to the point O1 in FIG. 3 of the patent literature 2, exists on the vertical center line X along which the presser die 12 moves upward and downward.

However, there is a disadvantage that holding the center O1 on the vertical center line X constantly does not be guaranteed in the long time, because the constant holding depends on the machining accuracy and the mounting state of the linear racks 35*a*, the arc racks 25*a*, and the dust invasion into the meshing portions, and further because the position of the rolling surface 20C changes radially due to the forces acting radially on the tooth plane in mesh, as described in the paragraph 0040 that the circular rolling surfaces 20C, 20C roll on the guide surfaces 31*a*, 31*a* and are forced by a pair of the lower dies 21, 22, respectively.

In addition, in the patent literature 2, it is stated that the facing distance between the first and second stoppers 51, 52 limiting the end surfaces of the pipe material mounted thereon can be adjusted by the screw on the position of the one stopper. However, there is another disadvantage that the pipe material is not mounted on the lower dies in correct when the pipe material has error in its dimension because the adjustable range is relatively small, and also the screw should be rotated clockwise and counter clockwise corresponding to fastening and loosing at each forming operation.

Further, as shown in FIGS. 5, 8 of the patent literature 2, because the lateral face die 61 is forced upward by the spring 68 in full time there is a dangerous possibility that the bent pipe material at high temperature moves upward while attaching to the presser die 12 and on the way falls down in the vicinity of the forming apparatus, when the presser die 12 moves upward after the forming is completed.

The present invention is proposed to solve the problems mentioned above.

The object of the present invention is to provide an elbow material, and a production device and a production method thereof, wherein the elbow material is formed by bending to a predetermined angle a metal hollow thick walled member of a given length having a hollow passage of an approximately circular section along an axial direction of the member with both ends opened, and approximately circular or at least one pair of parallel surfaces in the periphery of the member.

According to the production device and the production method of the present invention, there is no shift of the center point of bending of the metal hollow thick walled member. In addition, the bent and formed metal hollow thick walled member is not detached from the lower dies when an upper presser die moves upward, and a pair of parallel surfaces can be formed on the member for engaging a spanner.

Means for Solving the Problem

In order to achieve the object the elbow material is so constituted that it is formed by bending to a predetermined angle a metal hollow thick walled member of a given length having a hollow passage of an approximately circular section along an axial direction of the member with both ends opened, and approximately circular or at least one pair of parallel surfaces in the periphery of the member.

In the case, the peripheral sectional shape of the metal hollow thick walled member can be the tetragon, the hexagon or the octagon, preferably the regular tetragon, the regular hexagon or the regular octagon.

Furthermore, in order to achieve the object the elbow material production device according to the present invention is formed by bending to a predetermined angle a metal hollow thick walled member of a given length having a hollow passage of an approximately circular section along an axial direction of the member with both ends opened, and approximately circular or at least one pair of parallel surfaces in the periphery of the member and so constituted that comprises a toggle type link mechanism formed by a first guide member movably guiding a first axial member for a supporting point to a first direction perpendicular to the axial direction of the first axial member, a pair of link levers, each being pivotally connected to the first axial member at one end portion of the link lever, and a second guide member movably guiding the other end portion of the link lever to a second direction perpendicular to the axial direction of the first axial member, two half dies constituting one side (lower side) die arrangement formed so as to contact one side outer surface corresponding to approximately a half surface region in the longitudinal direction of the metal hollow thick walled member to be formed, an one side die arrangement holding member for fixedly holding each of the half die, each member being fixedly connected to the lateral surface of the link lever, an other side (upper side) die arrangement having a first contact surface and a second contact surface, the first contact surface contacting the other side outer surface of the metal hollow thick walled member in the state bent to a predetermined angle, and the second contact surface formed in the central portion contacting an outer surface portion of the first axial member so as to press the first axial member in the first direction, an other die arrangement holding member for fixedly holding the other side die arrangement, a first moving means for moving the other die arrangement holding member in the first direction, a second moving means for moving the first axial member in the first direction along the first guide member through contacting the one end portion of the link lever pivotally connected to the first axial member.

In the case, the elbow material production device can be provided with a stopper member which contacts the outer surface of the one side die arrangement holding member, the stopper member being located corresponding to the position of the first axial member at which the metal hollow thick walled member is bent to the predetermined angle.

Also, in the case, one side (lower side) die arrangement including the two half dies can be provided with a position limiting means for limiting the end side positions of the metal hollow thick walled member.

Also, in the case, at least one of the positions limiting means can be provided with a member with the position adjustable which contacts the end side of the metal hollow thick walled member.

Further, in the case, the first axial member can be constituted to be able to advance and retract in the axial direction in accordance with the movement in the first direction, and the end side of the first axial member can be constituted to contact and press the lateral surface of the metal hollow thick walled member.

Further, in the case, the end side of the first axial member can be constituted to contact the pair of parallel surfaces of the metal hollow thick walled member and hold the contact positions of one end surface in the axial direction of the first axial member.

Also, the toggle type link mechanism formed by the first guide member movably guiding the first axial member for the supporting point to the first direction perpendicular to the axial direction of the first axial member, the pair of link levers, each being pivotally connected to the first axial member at the one end portion of the link lever and the second guide member movably guiding the other end portion of the link lever to the second direction perpendicular to the axial direction of the first axial member, the two half dies constituting the one side (lower side) die arrangement formed so as to contact with the one side outer surface corresponding to approximately a half surface region in the longitudinal direction of the metal hollow thick walled member to be formed, and the one side die arrangement holding member for fixedly holding each of the half die, each being fixedly connected to the lateral surface of the link lever, can be constituted to put in a space surrounded by side wall plates (54, 56) and outer side wall plates (50,52) mounted on a base plate (16)

Also, in order to achieve the object the elbow material production method according to the present invention, which is formed by bending to a predetermined angle a metal hollow thick walled member of a given length having a hollow passage of an approximately circular section along an axial direction of the member with both ends opened, and approximately circular or at least one pair of parallel surfaces in the periphery of the member, is constituted to include the steps of preparing a bending apparatus which comprises a toggle type link mechanism formed by a first guide member movably guiding a first axial member for a supporting point to a first direction perpendicular to the axial direction of the first axial member, a pair of link levers, each being pivotally connected to the first axial member at one end portion of the link lever and a second guide member movably guiding the other end portion of the link lever to a second direction perpendicular to the axial direction of the first axial member, two half dies constituting one side (lower side) die arrangement formed so as to contact with one side outer surface corresponding to approximately a half surface region in the longitudinal direction of the metal hollow thick walled member to be formed, an one side die arrangement holding member for fixedly holding each of the half die, each being fixedly connected to the lateral surface of the link lever, an other side (upper side) die arrangement having a first contact surface and a second contact surface, the first contact surface contacting the other side outer surface of the metal hollow thick walled member in the state bent to a predetermined angle, and the second contact surface formed in the central portion contacting an outer surface portion of the first axial member so as to press the first axial member in the first direction, an other side die arrangement holding member for fixedly holding the other side die arrangement, a first moving means for moving the other side die arrangement holding member in the first direction, a second moving means for moving the first axial member in the first direction along the first guide member through contacting the one end portion of the link lever pivotally connected to the first axial member, a first process for arranging the two half dies on the same line through driving the second moving means, a second process for locating the metal hollow thick walled member heated in advance to the temperature capable of plastic deformation to the predetermined position of the half dies after the first process, a third process for contacting the second contact surface formed in the other side die arrangement to the outer surface portion of the first axial member through driving the first moving means and moving the holding member of the other side die arrangement to the metal hollow thick walled member, a fourth process for moving the first axial member with a first pressing force in the first direction through further driving the first driving means after the third process and causing the two half dies to depart from and slope each other in accordance with the moving, and as the result bending little by little the metal hollow thick walled member, a fifth process for allowing the first axial member to move in the first direction while in the fourth process the second moving means forces a second pressing force through the one end portion of the link lever to the first axial member, the second pressing force being smaller than the first pressing force and with the direction opposite to the first pressing force which is supplied to the first axial member through driving the first moving means, a sixth process for holding the other side die arrangement at a predetermined position in the first direction during a predetermined time interval using the first moving means, the predetermined position corresponding to the state in which the metal hollow thick walled member is bent to a predetermined angle through moving the first axial member in the first direction and contacting the other side die arrangement to the outer surface of the metal hollow thick walled member during the fourth process, a seventh process for departing the other side die arrangement from the metal hollow thick walled member bent to the predetermined angle through moving the other side die arrangement holding member in the direction opposite to the direction in the third process by means of the first moving means after the sixth process, a eighth process for returning the first axial member in the first direction so that the two half dies mounting the metal hollow thick walled member bent to the predetermined angle are arranged on the same line as the initial state through driving the second moving means after starting the seventh process.

In the case since the bending apparatus is provided with the stopper member which contacts the outer surface of the one side die arrangement holding member and locates corresponding to the position of the first axial member at which the metal hollow thick walled member has been bent to the predetermined angle, the stopper member can receive the first pressing force acting on the first axial member during the sixth process.

Also, in the case the half die can be provided with a position limiting means for limiting the end side positions of the metal hollow thick walled member.

Also, in the case at least one of the position limiting means can be provided with a member with the position adjustable which contacts the end side of the metal hollow thick walled member.

Further, in the case the first axial member can be constituted to be able to advance and retract in the axial direction in accordance with the movement in the first direction during the fourth process, and the end side of the first axial member can be constituted to contact and press the lateral surface of the metal hollow thick walled member.

Further, in the case the end side of the first axial member can be constituted to contact the pair of parallel surfaces of the metal hollow thick walled member and hold the contact positions in the axial direction during the fourth process.

Effect of the Invention

Since the elbow material with the polygonal periphery according to the present invention is formed in advance as the metal hollow thick walled member before it is bent to form the elbow shape so that the elbow material has the hollow passage of an approximately circular section along the axial direction of the member with both ends opened, and approximately circular or at least one pair of parallel surfaces in the periphery of the member, it is unnecessary to form a pair of parallel surfaces for the spanner engagement during bending formation.

Also, since the elbow material production device according to the present invention is formed by bending to a predetermined angle a metal hollow thick walled member of a given length having a hollow passage of an approximately circular section along an axial direction of the member with both ends opened, and approximately circular or at least one pair of parallel surfaces in the periphery of the member and so constituted that it comprises a toggle type link mechanism formed by a first guide member movably guiding a first axial member for a supporting point to a first direction perpendicular to the axial direction of the first axial member, a pair of link levers, each being pivotally connected to the first axial member at one end portion of the link lever and a second guide member movably guiding the other end portion of the link lever to a second direction perpendicular to the axial direction of the first axial member, two half dies constituting one side (lower side) die arrangement formed so as to contact one side outer surface corresponding to approximately a half surface region in the longitudinal direction of the metal hollow thick walled member to be formed, an one side die arrangement holding member for fixedly holding each of the half die, each member being fixedly connected to the lateral surface of the link lever, an other side (upper side) die arrangement having a first contact surface and a second contact surface, the first contact surface contacting the other side outer surface of the metal hollow thick walled member in the state bent to a predetermined angle, and the second contact surface formed in the central portion contacting an outer surface portion of the first axial member so as to press the first axial member in the first direction, an other die arrangement holding member for fixedly holding the other die arrangement, a first moving means for moving the other die arrangement holding member in the first direction, a second moving means for moving the first axial member in the first direction along the first guide member through contacting the one end portion of the link lever pivotally connected to the first axial member, the elbow material production device is strongly built and solid as a bending apparatus for the elbow material and enables to use it for long term.

Also, further since the elbow material production method according to the present invention, which is formed by bending to a predetermined angle a metal hollow thick walled member of a given length having a hollow passage of an approximately circular section along an axial direction of the member with both ends opened, and approximately circular or at least one pair of parallel surfaces in the periphery of the member, is constituted to include the steps of preparing a bending apparatus which comprises a toggle type link mechanism formed by a first guide member movably guiding a first axial member for a supporting point to a first direction perpendicular to the axial direction of the first axial member, a pair of link levers, each being pivotally connected to the first axial member at one end portion of the link lever and a second guide member movably guiding the other end portion of the link lever to a second direction perpendicular to the axial direction of the first axial member, two half dies constituting one side (lower side) die arrangement formed so as to contact with one side outer surface corresponding to approximately a half surface region in the longitudinal direction of the metal hollow thick walled member to be formed, an one side die arrangement holding member for fixedly holding each of the half die, each being fixedly connected to the lateral surface of the link lever, an other side (upper side) die arrangement having a first contact surface and a second contact surface, the first contact surface contacting the other side outer surface of the metal hollow thick walled member in the state bent to a predetermined angle, and the second contact surface formed in the central portion contacting an outer surface portion of the first axial member so as to press the first axial member in the first direction, an other side die arrangement holding member for fixedly holding the other side die arrangement, a first moving means for moving the other side die arrangement holding member in the first direction, a second moving means for moving the first axial member in the first direction along the first guide member through contacting the one end portion of the link lever pivotally connected to the first axial member, a first process for arranging the two half dies on the same line through driving the second moving means, a second process for locating the metal hollow thick walled member heated in advance to the temperature capable of plastic deformation to the predetermined position of the half dies after the first process, a third process for contacting the second contact surface formed in the other side die arrangement to the outer surface portion of the first axial member through driving the first moving means and moving the holding member of the other side die arrangement to the metal hollow thick walled member, a fourth process for moving the first axial member with a first pressing force in the first direction through further driving the first driving means after the third process and causing the two half dies to depart from and slope each other in accordance with the moving, and as the result bending little by little the metal hollow thick walled member, a fifth process for allowing the first axial member to move in the first direction while in the fourth process the second moving means forces a second pressing force through the one end portion of the link lever to the first axial member, the second pressing force being smaller than the first pressing force and with the direction opposite to the first pressing force which is supplied to the first axial member through driving the first moving means, a sixth process for holding the other side die arrangement at a predetermined position in the first direction during a predetermined time interval using the first moving means, the predetermined position corresponding to the state in which the metal hollow thick walled member is bent to a predetermined angle through moving the first axial member in the first direction and contacting the other side die arrangement to the outer surface of the metal hollow thick walled member during the fourth process, a seventh process for departing the other side die arrangement from the metal hollow thick walled member bent to the predetermined angle through moving the other side die arrangement holding member in the direction opposite to the direction in the third process by means of the first moving means after the sixth process, a eighth process for returning the first axial member in the first direction so that the two half dies mounting the metal hollow thick walled member bent to the predetermined angle are arranged on the same line as the initial state through driving the second moving means after starting the seventh process, the bending center position does not deviate in the metal hollow thick walled member, and in addition, the bent metal hollow thick walled member does not separate from the lower half dies in the one side die arrangement when the upper presser dies in the other side die arrangement moves upward.

BRIEF DESCRIPTION OF DRAWINGS

FIG. 6A is a view showing a detailed shape of an upper die wherein the figure (a) designates the enlarged upper die in FIG. 2, and the figure (b) designates a detailed shape of the upper die (a) viewed from the direction of Y.

FIG. 6B is a view showing another embodiment of the detailed shape of the upper die wherein the figure (a) designates the enlarged upper die in FIG. 2, and the figure (b) designates a detailed shape of the upper die (a) viewed from the direction of Y.

FIG. 10B is a view showing a process for forming a thick walled tube like member with a circular outer shape and a predetermined length having a given thick wall made by cutting a steel wire rod in solid core to a given length and then by processing in the deep drawing.

FIG. 11A is a view of the elbow material with the periphery approximately shaped in a square and with two pieces separated by cutting at the bent portion.

FIG. 11B is a sectional view of pieces of the elbow material seen from above.

FIG. 12B is a sectional view of the elbow material in FIG. 12A seen from above.

FIG. 13A is a perspective view of an elbow material with the periphery approximately shaped in the hexagonal.

FIG. 14 shows a deformed hollow hole seen from one end of an elbow with a screw machined from the elbow material with the circular periphery.

DESCRIPTION OF NOTATION

Figure 1:
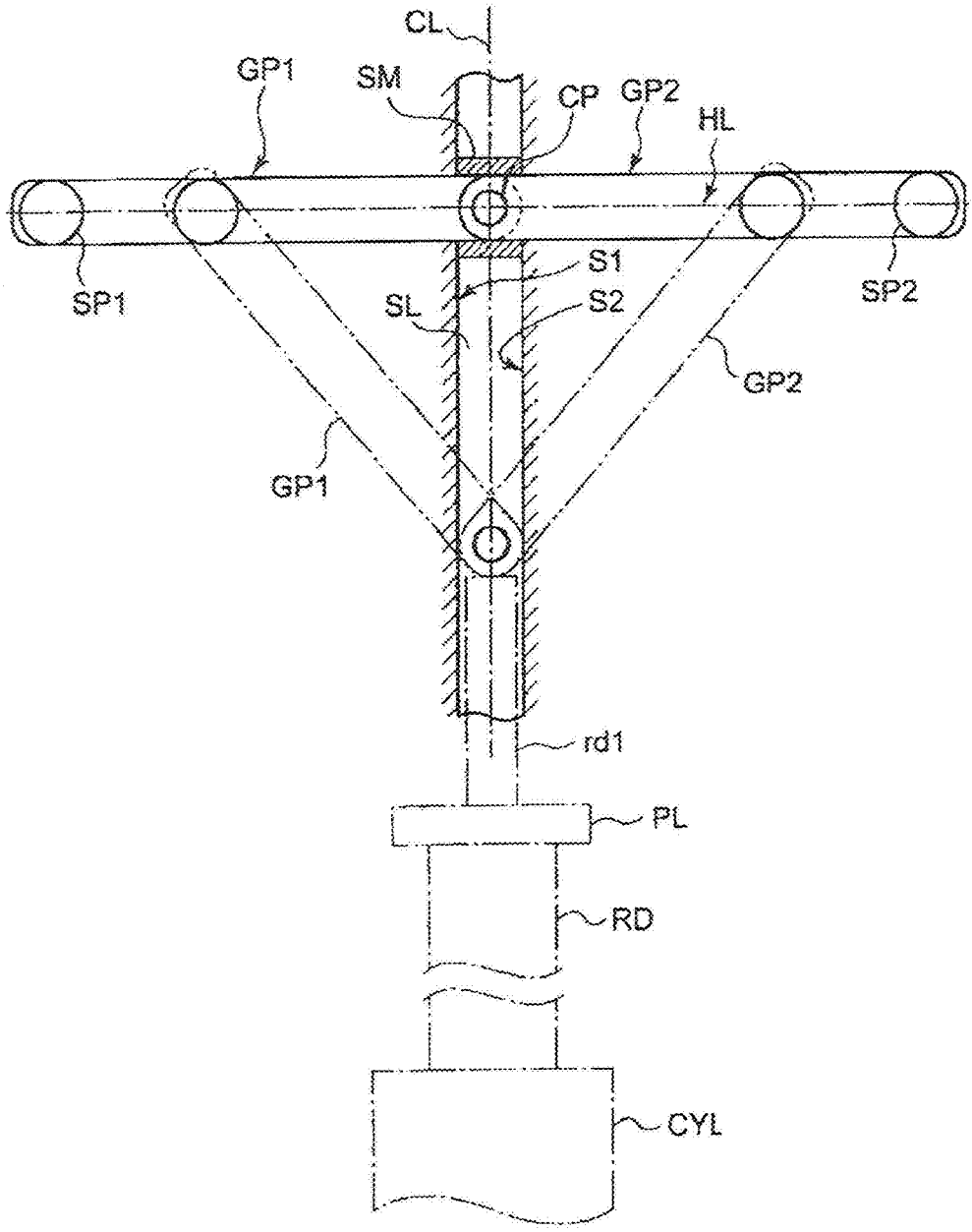
FIG. 1 is a view for explaining a toggle type mechanism used in the present invention.

10 base frame
12 supporting column
14 base
16 base plate
18 bending formation unit
20*a*, 20*b* guide member
22 hydraulic cylinder
24 rod
26 supporting plate
28*a*, 28*b* contacting member
30 column
32 head
34 ram cylinder
36 ram
38 holding plate
40 upper die
42 upper die holding member
44 guide bar
50, 52 outer side wall plate
54, 56 side wall plate
60*a*, 60*b* plate
62*a*, 62*b* half die
64*a*, 64*b* through pin
66*a*, 66*b* guide member
68 snap ring
70 spring
72 slide member
80*a*, 80*b* die holding member
82*a*, 82*b* half die
84 spacer
86 piece member
88 hydraulic cylinder unit
88*a* fixing member
88*b* bracket
88*c* piston rod
pressing piece member
92*a*, 92*b* stopper
94*a*, 94*b* contacting member
96*a*, 96*b* contacting portion
100*a*, 100*b* die portion
CP center pin
CP1 portion with small diameter
CP2 end side
CP3 left end side
F1 first contacting surface
Fa contacting surface
FS vertical plane portion
GP1, GP2 guide plate
P1, P2, P3 back pressure
PM metal hollow thick walled member
S allowable space in plastic deformation

BEST MODE OF CARRYING OUT THE INVENTION

As a preferred embodiment according to the present invention, an elbow material production method will be explained in detail referring to the accompanying drawings.

FIG. 1 is a view for explaining a toggle type mechanism used in the present invention.

In FIG. 1 a reference notation SL1 designates a first guide groove provided in the vertical direction at the central portion in FIG. 1. On the upper portion in FIG. 1 there is provided with a second guide groove SL2 in the horizontal direction and perpendicular to the first guide groove SL1.

A reference notation SM is a sliding member which contacts groove walls S1 and S2 of the first guide groove SL1 and slides on them.

On the front side of the sliding member SL1 there is provided with a center pin CP in the integrated fashion. One end portion of each guide plates GP1 and GP2 is turnably mounted on the center pin CP. On the other hand, the other end portions of the guide plates GP1 and GP2 are turnably provided with support pins SP1 and SP2, respectively.

The support pins SP1 and SP2 are guided in the second guide groove SL2 slidably. When the sliding member SM moves downward along the first guide SL1, the center pin CP moves downward along a center line CL together with the sliding member. Accordingly, the guide plates GP1 and GP2 gradually incline as shown in a chain line, from the initial and horizontal state.

During this operation each axis center of the support pins SP1 and SP2 moves on a horizontal center line HL of the second guide groove SL2 so that they move closer to each other.

The lower portion shown by chain lines in FIG. 1 shows that a contacting member rd1 mounted through a support plate PL on the upper end of a rod RD of a hydraulic cylinder CYL contacts an arc like circumference of the one end of the guide plates GP1 and GP2 surrounding the center pin CP The center pin CP, the first guide groove SL1 and the second guide groove SL2 correspond to a first axial member, a first guide member and the second guide member in the present invention, respectively. Also, the vertical direction corresponding to the center line CL and the horizontal direction corresponding to the center line HL are the first direction and the second direction in the present invention. Further, the hydraulic cylinder CYL, the rod RD, the support plate PL and contacting member rd1 constitute a second moving means in the present invention.

Figure 2:
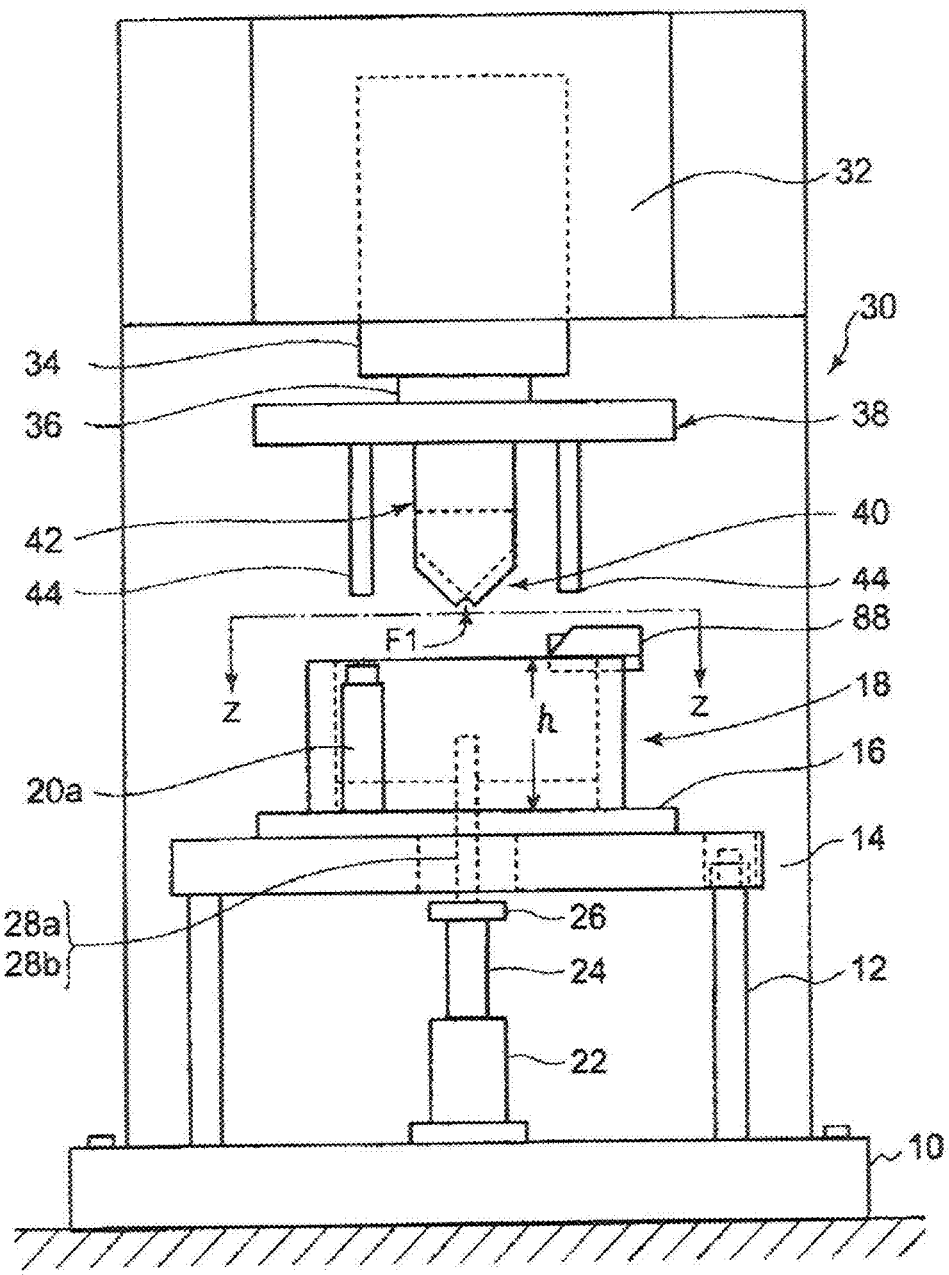
FIG. 2 is an elevation view of whole of a bending apparatus to which the present invention is applied.

FIG. 2 shows an elevation view of a bending apparatus for a metal hollow thick walled member to which the present invention is applied.

In FIG. 2 a reference numeral 10 is a base frame fixed in the land. On the base frame 10 there are vertically and fixedly provided with a plurality of supporting columns 12, on the upper ends of which a base 14 is mounted. On the upper surface of the base 14 there is fixedly provided with a base plate 16 on which a bending formation unit 18 including a lower side die are fixedly mounted.

A reference numeral 88 is, as stated hereinafter, a hydraulic cylinder unit to press one end of a metal tube from which an elbow material is formed.

A reference numeral 20*a* is a guide member mounted on the base plate 16 to guide a guide bar 44.

A reference numeral 30 is a column fixed in the vertical direction on the base frame 10, on which a head 32 is mounted. A ram cylinder 34 is mounted on the head 32. The ram cylinder 34 is provided with a ram 36 which advances and retracts vertically. At the lower end of the ram 36 there is fixedly provided with a holding plate 38 on the lower surface of which an upper die holding member 42, which is fixed upper die 40, is fixedly mounted.

An upper end of the guide bar 44 is mounted on the holding plate 38. The guide bar 44 is inserted into a hole provided in the guide member 20*a* and guided, as the ram 36 moves downward. The ram cylinder 34, the ram 36 and the holding plate 38 constitute a first moving means in the present invention. Further, reference numerals 22, 24, 26 and 28 correspond to the cylinder CYL, rod RD, supporting plate PL and contacting member rd1 in FIG. 1, respectively. Those constitute, as stated previously, a second moving means in the present invention.

Figure 3:
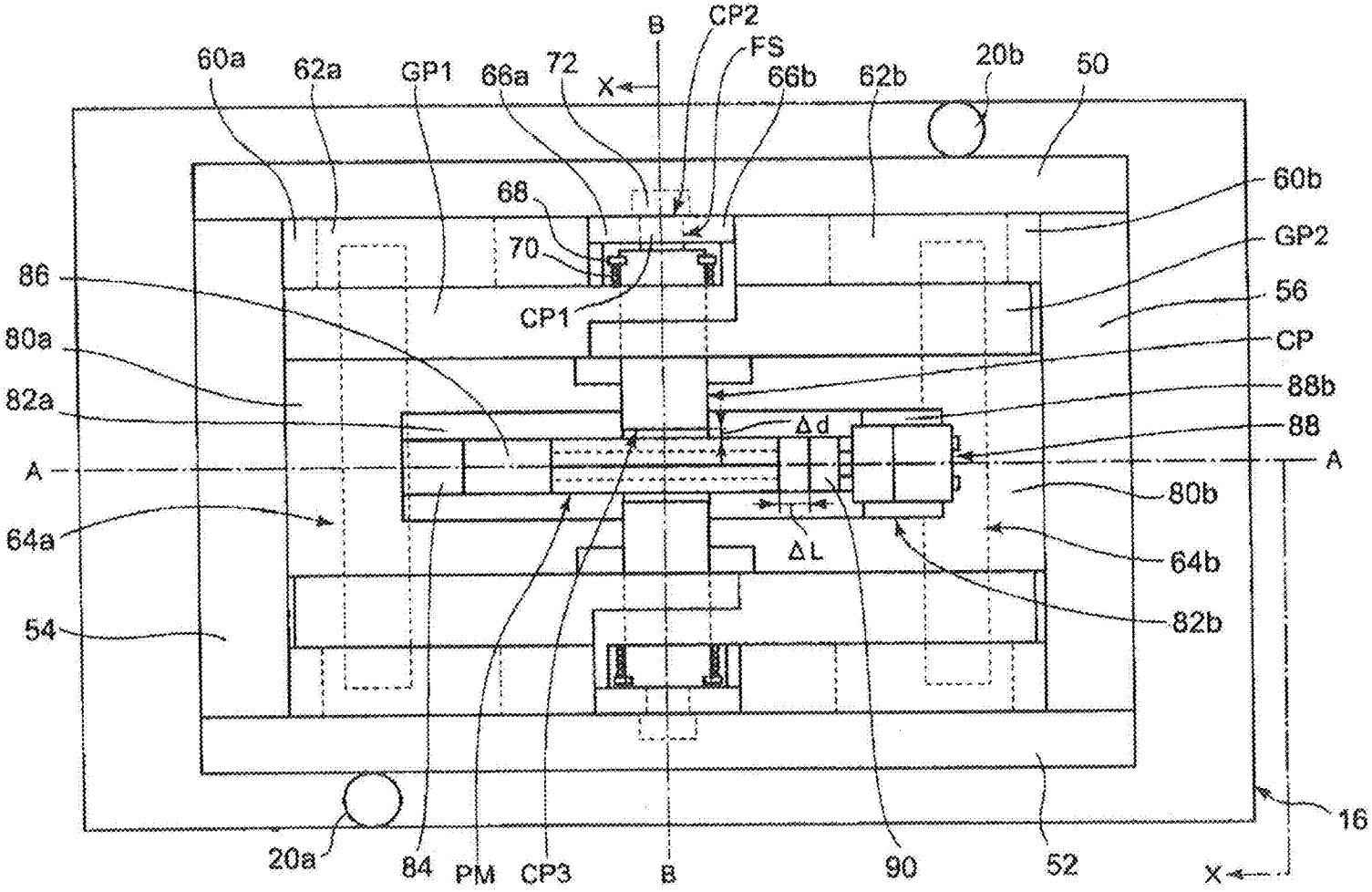
FIG. 3 is a view taken along a line Z-Z with an arrow at the ends which shows a detailed plane view of a bending formation unit in the bending apparatus.

FIG. 3 is a view taken along a line Z-Z in with an arrow at the ends in FIG. 2, which shows a detailed plane view of a bending formation unit in the bending apparatus.

In FIG. 3 reference numerals 50 and 52 are outer side wall plates, and reference numerals 54 and 56 are side wall plates, each is fixedly and vertically provided on the surface of the base plate 16. A space is formed with a height of h surrounded in an approximately rectangular shape by those outer side wall plates and side wall plates, in which a bending mechanism of the bending formation unit is put in with the mechanism symmetrically formed in upper and lower portions divided by a line A-A.

The upper portion of the line A-A in the bending mechanism is explained here.

There are fixedly provided with plates 60*a* and 60*b* inside the outer side wall plate 50 in FIG. 3. The center pin CP is located in the mid position between the plates 60*a* and 60*b*. There are turnably provided with the one end portions of the guide plates GP1 and GP2 on a central portion of the center pin CP along B-B line in the axial direction. The other end portions of the guide plates GP1 and GP2 are run through by through pins 64*a* and 64*b*. The end portions of through pins 64*a* and 64*b* are put in inside elongate holes 62*a* and 62*b* formed at a given height in the plates 60*a* and 60*b* so that they can move only in the horizontal direction.

The horizontal direction of the elongate holes 62*a* and 62*b* formed at the given height corresponds to the horizontal line HL in FIG. 1. Also, the through pins 64*a*, 64*b* correspond to the support pins SP1 and SP2, respectively.

A reference notation CP1 is a portion with small diameter of the center pin CP, on the left and right sides of which a vertical planes FS are formed.

Reference numerals 66*a*, 66*b* are guide members to contact the vertical planes FS of the portion CP1 so that the center pin CP is guided vertically, corresponding to the direction perpendicular to the drawing sheet plane.

A reference numeral 68 is a snap ring which functions to force the center pin CP in the upward direction in the figure by receiving the elastic rebounding force of a spring 70 located between the guide plates GP1 and GP2.

A reference numeral 72 is a sliding member which contacts an end side CP2 of the portion CP1 of the center pin CP, the surface of which is formed vertically and hardened by means of hardening process.

Accordingly, when the center pin CP moves downward in the vertical directions perpendicular to the sheet, the other end portion CP3 of the center pin CP functions to hold the distance between a pair of parallel surfaces of the metal hollow thick walled member PM located on the line A-A to form the elbow material, in the state that the end portion CP3 contacts the parallel surfaces.

In addition, when the guide plates GP1 and GP2 are in the horizontal state, an axial center line of the center pin CP intersects with an axial center line of the metal hollow thick walled member PM on the same plane.

Reference numerals 80*a* and 80*b* are die holding members respectively located in the left and right side sectioned by the B-B line, which are fixedly mounted on the lateral sides of the guide plates GP1 and GP2.

On the die holding members 80*a* and 80*b* there are fixedly mounted a pair of half dies 82*a* and 82*b* along the A-A line. When the guide plates GP1 and GP2 are in the horizontal state, both of the half dies are arranged linearly on the same line, thereby constituting a single lower die.

A reference numeral 84 is a spacer arranged on the A-A line, and a reference numeral 86 is a piece member for a position limiting arranged between the spacer 84 and the left end side of the metal hollow thick walled member PM. A reference numeral 88 is a cylinder unit which is fixedly mounted on the die holding member 80*b* mounting the right side half die 82*b*. At the left end of the piston rod of the cylinder a pressing piece member 90 is mounted, thereby enabling to freely adjust a distance ΔL between the left end side of the piston rod and the right end side of the metal hollow thick walled member PM with a length L.

In the case, it is possible to press the right end side of the metal hollow thick walled member PM through the pressing piece member 90 by setting a stroke of the piston rod longer than the distance ΔL.

Also, on the lower side of the A-A line in FIG. 3 similar constitutional elements mentioned above are arranged. However, those detailed explanations are deleted to avoid overlap.

Figure 4A:
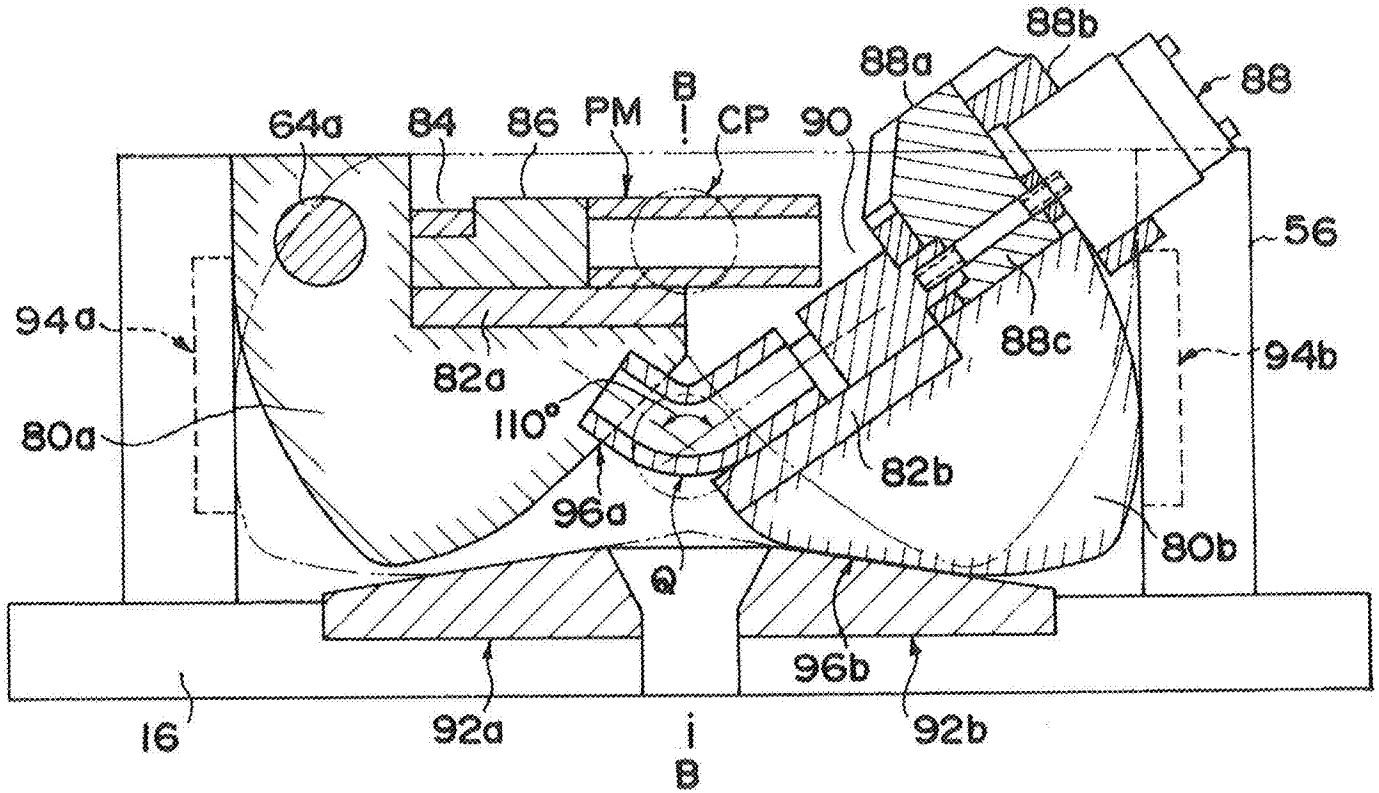
FIG. 4A is a view corresponding to a sectional view taken along a line A-A in FIG. 3 wherein the left side half view designates a tube member mounted on a left side half die, and the right side half view designates that guide plates incline from horizontal as a center pin moves downward, and as the result, the pipe member is bent to a predetermined angle and held to mount on the left side half die.

FIG. 4A is a view corresponding to a sectional view taken along the line A-A in FIG. 3. The left side half of the view shows that the tube member PM (corresponding to the metal hollow thick walled member according to the present invention) is mounted on the divided half die 82*a* fixed on the die holding member 80*a* under the conditions that the guide plates GP1 and GP2 are in the horizontal state, and the axis center line of the center pin CP intersect with the axis center line of the tube member PM.

The right side half of the view shows that guide plates GP1 and GP2 incline from the horizontal state as a center pin CP moves downward, and as the result, the tube member PM is bent to a predetermined angle, for instance to 110 degree, and held to remain on the right side half die 82*b* fixed on the die holding members 80b.

In FIG. 4A the hydraulic cylinder unit 88 is fixedly held by a bracket 88*b* which is mounted on one end of a fixing member 88*a* fixedly mounted on the die holding member 80*b*. The pressing piece member 90 is mounted on the top portion of the piston rod 88*c* slidably arranged through a through hole in the fixing member 88*a*.

Reference numerals 92*a* and 92*b* are stoppers with slopes which contact contacting portions 96*a* and 96*b* formed as a plane on an inner portion of the circumference of the die holding members 80*a* and 80*b*.

As shown in the right side half of the view in FIG. 4A, the stoppers 92*a* and 92*b* are fixedly mounted on a base plate 16.

The portion other than the contacting portions 96*a* and 96*b* on the circumference of the die holding members 80*a* and 80*b* are formed in the shape of circular arc, and the center point of the circular arc at the outer side portion is the same with that of the center pin CP. Accordingly, the outer side portion of the circular arc is formed to roll on the inner surface of the side wall plates 54 and 56 while contacting.

Reference numerals 94*a* and 94*b* are contacting members which contact the outer side portion of the circular arc, each being embedded in the side wall plates 54 and 56. The contacting members 94*a* and 94*b* are formed with the surfaces hardened by the hardening process.

In the case, the reason why the circumferences (circular arc portion) of the die holding member 80*a* and 80*b* roll on the contacting members 94*a* and 94*b* while contacting is to protect the center pin CP.

Figure 4B:
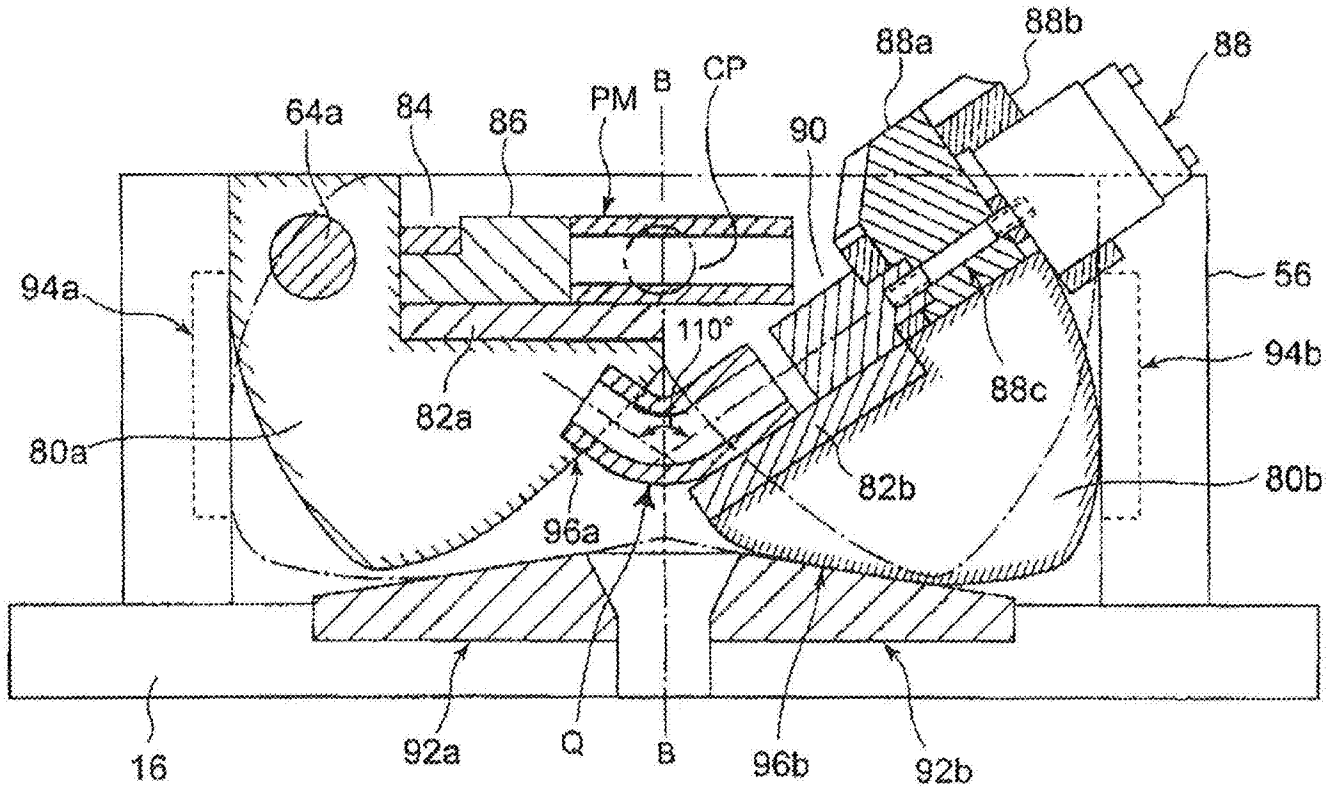
FIG. 4B is a view corresponding to a sectional view taken along a line A-A in FIG. 3 wherein the left side half view designates a metal hollow thick walled member having preferably a polygonal shape in the periphery mounted on the left side half die, and the right side half view designates that guide plates incline from horizontal as a center pin moves downward, and as the result, the metal hollow thick walled member is bent to a predetermined angle and held to mount on the left side half die.

Namely, when the bent and outer portion Q of the tube member PM, as shown in FIGS. 4A and 4B, extends to spread out in pressing as the center pin CP moves downward, the die holding member 80*a* and 80*b* also are forced to extend and spread out, and as the result, a shearing force exerts on the center pin CP through the rotation portion of the guide plates GP1, GP2.

In order to protect the center pin CP by reducing this shearing force the side wall plates 54 and 56 receive and absorb the force perpendicular to the rolling contact surfaces.

Of course, it is possible to bear up the shearing force (perpendicular direction force) by increasing rigidity of the center pin CP.

FIG. 4B is a view corresponding to a sectional view taken along the line A-A in FIG. 3. The left side half of the view shows that a metal hollow thick walled member PM with a hexagonal shape in the periphery is mounted on the divided half die 82*a* fixed on the die holding member 80*a* under the conditions that the guide plates GP1 and GP2 are in the horizontal state, and the axis center line of the center pin CP intersect with the axis center line of the metal hollow thick walled member PM.

The right side half of the view shows that guide plates GP1 and GP2 incline from the horizontal state as the center pin CP moves downward, and as the result, the metal hollow thick walled member PM is bent to a predetermined angle, for instance to 110 degree, and held to remain on the right side half die 82*h* fixed on the die holding member 80*b*. The detailed explanations of the constitutional elements in FIG. 4B are deleted because of the same with those of FIG. 4A.

Figure 5A:
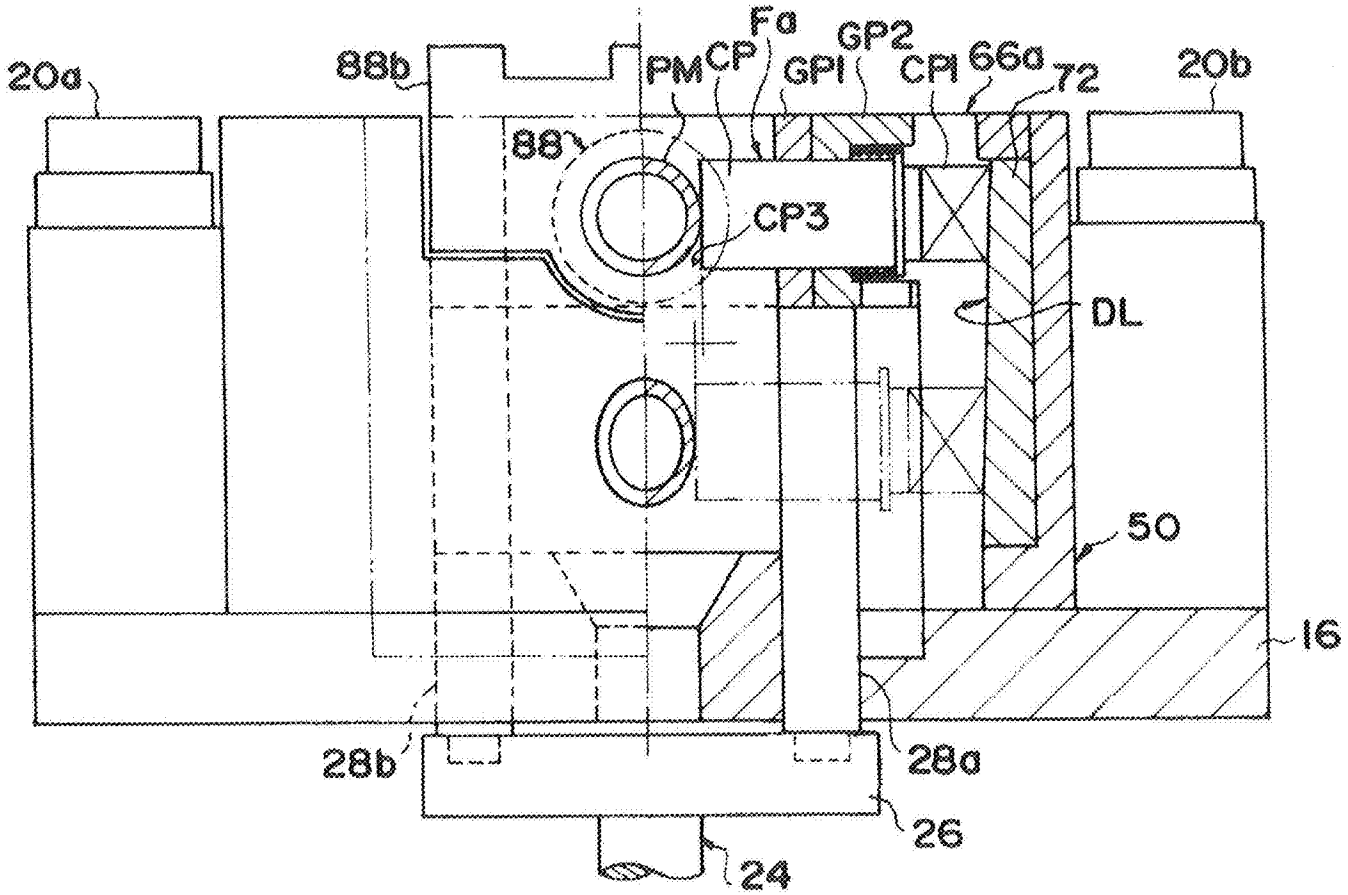
FIG. 5A is a sectional view taken along a line X-X with an arrow at the ends in FIG. 3 wherein the right side half view designates a detailed guide mechanism to guide the center pin in the vertical direction.

FIG. 5A is a sectional view taken along a line X-X with an arrow at the ends in FIG. 3 wherein the right side half of the view shows a detailed guide mechanism to guide the center pin CP in the vertical direction.

In FIG. 5A the sliding member 72, as stated previously, is fixedly put in on the outer side wall plate 50. As shown in the figure, an inclined plane DL is formed on the sliding member 72, to which the end side CP2 of the portion with small diameter CP1 contacts. The lateral face of the portion with small diameter CP1 of the center pin CP has the vertical plane portion FS on the both sides which contact the guide members 66*a* and 66*b*, as stated previously.

A reference notation Fa is a contacting surface formed on the upper circumference portion of the center pin CP, which contacts a first contacting surface F1 formed on an upper die 40 (shown in FIG. 2).

The center pin CP in the figure is arranged at the most upward position, and the center axis line positions at the same height with that of the tube member PM mounted on the pair of lower dies.

A reference numeral 88*b* is the bracket for fixedly holding the hydraulic cylinder unit 88 mentioned above. At the position of the center pin CP, shown with a chain line below, the left side face CP3 of the center pin CP is shifted by the distance d1 toward left due to the inclined face DL, thereby pressing the lateral face of the tube member PM.

The lower and outer face of the one ends of the guide plates GP1 and GP2 are formed in the shape of circular arc, and the lower and outer face contacts the upper end face of one contacting member 28*a* which is vertically provided in a support plate 26 fixed to a rod 24.

Figure 5B:
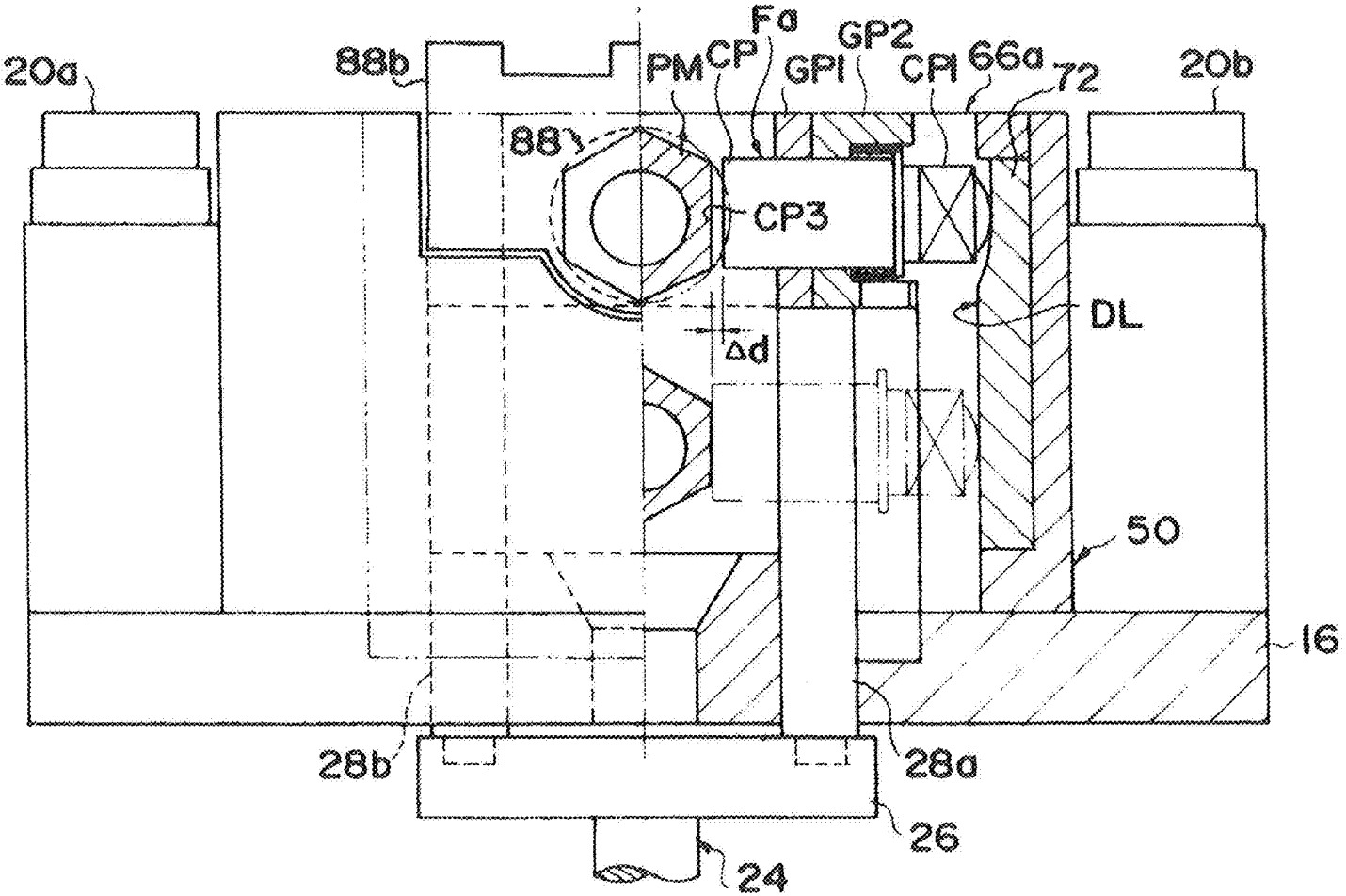
FIG. 5B is another sectional view taken along a line X-X with an arrow at the ends in FIG. 3 wherein the right side half view designates a detailed guide mechanism to guide the center pin in the vertical direction.

FIG. 5B is a sectional view taken along a line X-X with an arrow at the ends in FIG. 3 wherein the right side half of the view shows a detailed guide mechanism to guide the center pin CP in the vertical direction.

In FIG. 5B the sliding member 72, as stated previously, is fixedly put in on the outer side wall plate 50. As shown in the figure, a vertical plane DL is formed on the sliding member 72, to which the end side CP2 of the portion with small diameter CP1 contacts. The lateral face of the portion with small diameter CP1 of the center pin CP has the vertical planes FS on the both sides which contact the guide members 66*a* and 66*b*, as stated previously.

A reference notation Fa is a contacting surface formed on the upper circumference portion of the center pin CP, which contacts a first contacting surface F1 formed on an upper die 40 (shown in FIG. 2).

The center pin CP in the figure is arranged at the most upward position, and the center axis line positions at the same height with that of the metal hollow thick walled member PM mounted on the pair of lower dies.

A reference numeral 88*b* is the bracket for fixedly holding the hydraulic cylinder unit 88 mentioned above. At the position of the center pin CP, shown with a chain line below, the left side face CP3 of the center pin CP is shifted by the distance Δd toward left due to the vertical plane DL, thereby holding the lateral face of the metal hollow thick walled member PM to the shifted distance.

The lower and outer face of the one ends of the guide plates GP1 and GP2 are formed in the shape of circular arc, and the lower and outer face contacts the upper end face of one contacting member 28*a* which is vertically provided in a support plate 26 fixed to a rod 24.

FIG. 6A is a view showing a detailed shape of an upper die wherein the figure (a) designates the enlarged upper die 40 in FIG. 2, and the figure (b) designates a detailed shape of the upper die viewed from the direction of Y.

In the figure (a) reference numerals 100*a* and 100*b* are die portions which contact the approximately upper half of the circumference of the tube member PM when it has been bent and formed as the elbow material. Also, a reference notation F1 is a first contacting surface which contacts with the contacting surface of the center pin CP.

Further, in the figure (b) of FIG. 6A reference notations F1*a* and F1*b* are first contacting surfaces of the upper die 40 contacting with the contacting surface Fa of the center pin CP arranged in a way that each center pin CP is facing and interleaves the tube member PM therebetween, as shown in FIG. 3.

FIG. 6B is a view showing another embodiment of the detailed shape of the upper die 40 wherein the figure (a) designates the enlarged upper die 40 in FIG. 2, and the figure (b) designates a detailed shape of the upper die (a) viewed from the direction of Y.

In the FIG. 6B (a), the same figure, reference numerals 100*a* and 100*b* are die portions which contact the approximately upper half of the circumference of metal hollow thick walled member PM when it has been bent and formed as the elbow material. Also, a reference notation F1 is a first contacting surface which contacts with the contacting surface of the center pin CP.

Further, in the figure (b) of FIG. 6B reference notations F1*a* and F1*b* are first contacting surfaces of the upper die 40 contacting with the contacting surface Fa of the center pin CP arranged in a way that each center pin CP is facing and interleaves the metal hollow thick walled member PM therebetween, as shown in FIG. 3.

Figure 7:
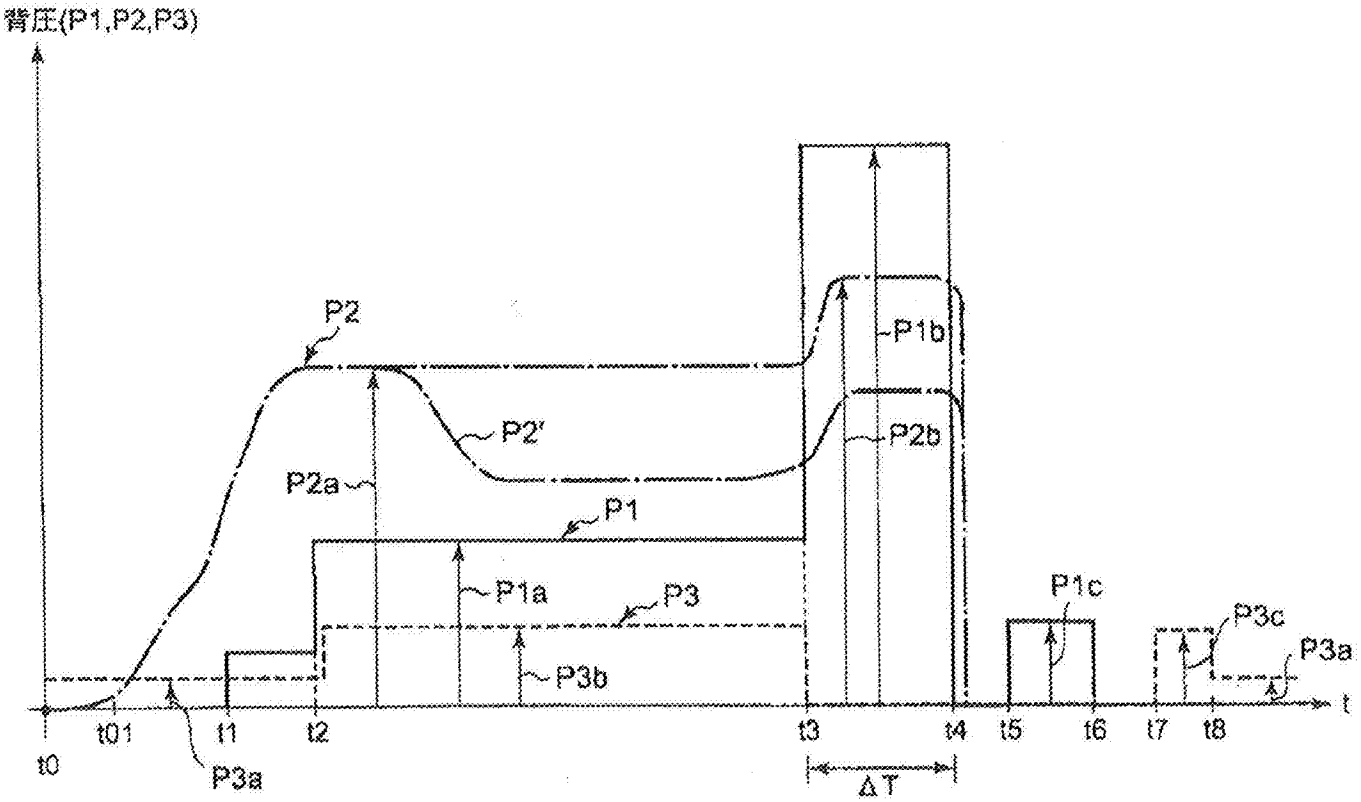
FIG. 7 shows a graph in which the ordinate axis designates a behavior of changes of a back pressure of a ram cylinder corresponding to a bending force to the metal hollow thick walled member, a back pressure of a high pressure cylinder unit corresponding to a pressing force to the end surface of the metal hollow thick walled member, and a back pressure of a hydraulic cylinder pressing the center pin upward through the guide plates from the lower side, and in which the abscissa axis designates tine passage in a process from start to finish for forming the elbow material.

FIG. 7 shows a graph in which the ordinate axis designates a behavior of respective changes of a back pressure P1 of a ram cylinder 34 corresponding to a bending force to the metal hollow thick walled member PM, a back pressure P2 of a high pressure (350 Kg/cm$^2$ at a maximum) cylinder unit 88 corresponding to a pressing force to the end surface of the metal hollow thick walled member PM, and a back pressure P3 of a hydraulic cylinder 22 pressing the center pin CP upward through the guide plates GP1 and GP2 from the lower side, and in which the abscissa axis designates tine passage t in a process from start to finish for forming the elbow material.

In the graph shown in FIG. 7, at the time t0 the metal hollow thick walled member PM is mounted on the lower die formed by two half dies. Also, in the graph the time t1 designates a time at which the upper die holding member 42 starts to move downward due to the ram cylinder 34, and the time t2 designates a time at which the first contacting surface F1 of the upper die 40 contacts the contacting surfaces Fa and Fb of the center pin CP.

Further, the time t3 designates a time at which the contacting portions 96*a* and 96*b* formed in the circumference of the die holding members 80*a* and 80*b* contact the slopes of the stoppers 92*a* and 92*b*.

The time t4 designates a time at which the pressing time interval terminates for pressing the upper die 40 for the interval ΔT continuously, and the time t5 designates a time at which the upper die 40 starts to move upward. Further, time t6 designates a time at which the upper die 40 reaches a position to limit the upward movement of the upper die 40 and becomes to a stopping state (clamped) there, and the time t7 designates a time at which the contacting members 28*a* and 28*b* start to move upward due to the hydraulic cylinder 22 in order to move the center pin CP upward after the time t5 designating the starting time of the upward movement of the upper die 40. Further, the time t8 designates a time at which the pair of half dies in the lower die become to be arranged linearly on the same line after upward movement of the center pin CP terminates. Also, here, it is possible to anticipate the time t7 than the time t6.

Then, a process for manufacturing the elbow material from the metal hollow thick walled member PM will be explained.

The ram cylinder 34 of the bending apparatus shown in FIG. 2 is provided with a pressing force of 30 tons at a maximum.

As shown in FIG. 10B, the metal hollow thick walled member PM is produced by cutting a steel wire rod in solid core such as the steel material of S45C to a given length in advance, then forming a thick walled tube like member having a circular circumference in the periphery with a given thickness and a given length by means of the deep drawing processing and then performing the milling operation so as to form the periphery with a pair of parallel surfaces. This metal hollow thick walled member PM is heated up to the temperature of 800° C. by means of the high frequency induction heating device (not shown) located near the bending apparatus. In such temperature range, for instance, in the range of 750 to 800° C. it is very easy to cause plastic deformation in the member PM by applying external forces thereto, compared with plastic deformation in the range of the room temperature, though the member PM holds its shape as the hollow thick walled member.

In FIG. 7 at the tine t0 the metal hollow thick walled member PM is mounted on the horizontally arranged one pair of half dies 82*a* and 82*b*, the member PM being heated and transported to the half dies in advance. Immediately after mounting, one end side of the metal hollow thick walled member PM is pressed by the hydraulic cylinder unit 88.

Referring to the wave form of the back pressure P1, the ram 36 starts to move downward at the time t1, and then, when the first contacting surface F1 of the upper die 40 contacts the corresponding contacting surface Fa of the center pin CP at the time t2 the back pressure P1 in the ram cylinder 34 becomes to P1*a* due to the upraise.

The pressing forces remain on approximately constant in the range of 2 to 5 tons, which is applied to the center pin CP from the upper die 40, corresponding to the back pressure P1*a*. In this time interval, as shown in FIG. 5, the center pin CP moves downward while being guided by the guide members 66*a* and 66*b*. The guide plates GP1 and GP2 incline gradually as the center pin CP moves downward, because the other end portions of the guide plates move only in the horizontal direction due to the horizontally restricted movement of the through pins 64*a* and 64*b*, and as the result, the lower side die holding members 80*a* and 80*b* incline and at the same time the pair of half dies 82*a* and 82*b* constituting the lower side die also incline so that the half dies incline and separate each other.

Accordingly, as shown in FIGS. 4A and 4B the metal hollow thick walled member PM is gradually bent.

At the time t3 the contacting surfaces 96*a* and 96*b* formed in the die holding members 80*a* and 80*b* contact the stoppers 92*a* and 92*b*, and such contacting state is held to the time t4. In this time interval of ΔT the ram cylinder 34 is held on the maximum back pressure P1*b* corresponding to the pressing forces of 30 tons.

Then, at the time t5 the upper die 40 moves upward and separates from the elbow material formed, and then at the time t6 the upper die 40 stops the retract movement to the most upward limiting position.

On the other hand, referring to the wave form of the back pressure P3 in the hydraulic cylinder 22 which forces the center pin CP upward in this interval, the cylinder 22 holds the guide plates and so on horizontally from the times t0 to t2.

When the time t reaches t2, the upper die 40 contacts the center pin CP, and as the result the contacting member 28*a* (referring to FIG. 5) is pressed downward through the one end portion of the guide plates. Accordingly, the back pressure P3 rises up to P3*b* greater than P3*a* and then, the difference between the back pressure P1*a* in the ram cylinder 34 and the back pressure P3*b* is held to be constant until the time t3. At the time t3 the back pressure P3 becomes to be zero temporally because the die holding members 80*a* and 80*b* contact the stoppers 92*a* and 92*b*. And then, at the time t7 after t5 the hydraulic cylinder 22 is initiated again with the back pressure P3*c* which forces to move the contacting member 28*a* upward and to move the center pin CP upward together with the formed elbow material. And then at the time t8 the guide plates GP1 and GP2 return to the initial state of horizontal arrangement. Then the back pressure P3 becomes to P3*a* of the starting state. In the case the time t7 does not restrict to later than t6, as stated previously.

Also, in this interval, referring to the wave form of the back pressure P2 in the hydraulic cylinder unit 88 pressing the one end portion of the metal hollow thick walled member PM, as stated previously, when the metal hollow thick walled member PM heated to the given temperature is mounted on the of half dies 82*a* and 82*b* constituting the lower side die horizontally by the transport means at the time to, the hydraulic cylinder unit 88 is initiated and then the pressing piece member 90 contacts the right end face of the metal hollow thick walled member PM at the time t01, as shown in FIG. 3. The back pressure P2 rises up continuously and at the time t2 it becomes to P2*a*, and then remains on P2*a* till the time t3. At the time t3 the back pressure P3 rises up to P2*b* corresponding to the back pressure p1*b* and then at the time t4 it becomes to zero, thereafter the pressing piece member 90 separates from the end face and retracts (the wave form after the time t4 is deleted). In addition the pressure P2 can be set to become temporarily lower than P2*a* like the wave form P2' after the time t2.

In addition, the reason why the wave form P2 rises up to P2*a* prior to the time t2 is such that the outer bent portion Q of the metal hollow thick walled member PM, as shown in FIGS. 4A and 4B, becomes thinner in the wall thickness due to the bending operation, and in order to fill up the thinner portion a tumor is formed in the internal portion of the bending portion in the metal hollow thick walled member PM by pressing the end side of the member PM in advance.

Figure 8:
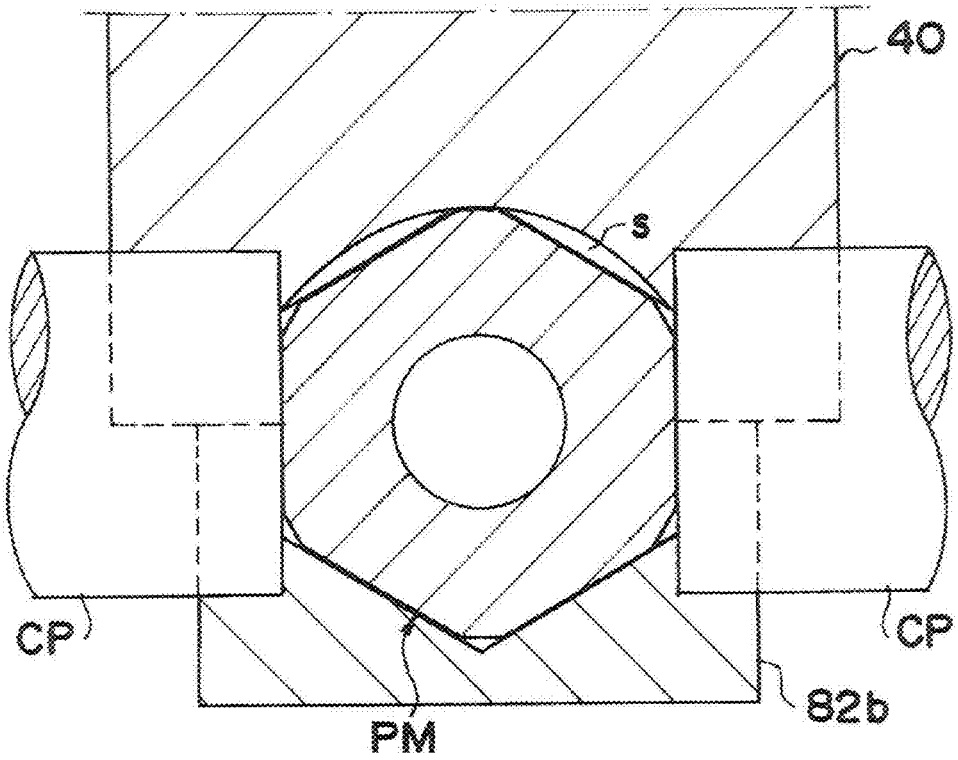
FIG. 8 is a view showing position relationships among the metal hollow thick walled member mounted on the lower side die, the upper side die and the center pins in the sectional view taken along a line B-B in FIG. 3.

FIG. 8 is a view showing position relationships among the metal hollow thick walled member PM mounted on the lower half die 82*b*, the upper die 40 and the center pin CP in the sectional view taken along a line B-B in FIG. 3.

In FIG. 8 a reference notation S is an air gap for receiving plastic deformation, which is formed in the vicinity of the bending center portion in the upper die 40. The air gap is also a space to receive the plastic deformation generated when the upper portion of the metal hollow thick walled member PM with the hexagonal shape in the sectional periphery is compressed in the bending formation. As seen in FIG. 8 the metal hollow thick walled member PM (hexagon in the periphery) has sides extending left and right from the upper top, and relatively, the sectional area in hexagonal peripheryis smaller than that in the circular periphery by the area of S.

Accordingly, since the quantity of the thick walled member existing between the hollow hole and each the side is small that much, in the plastic deformation generated by compression force acting on the portion in the bending formation the quantity fluidized to the vicinity space is relatively small, and as the result, the plastic deformation from the hollow circular hole to the hollow elliptic hole is reduced.

Figure 9A:
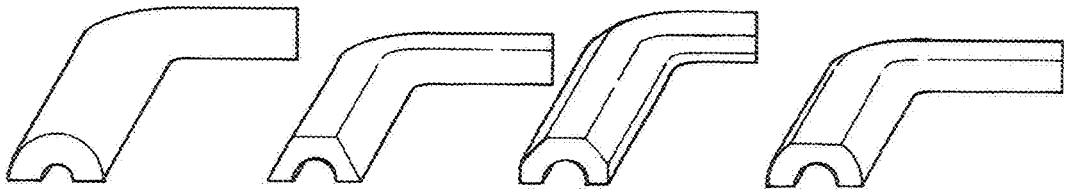
FIG. 9A is a view showing outer shapes of elbow materials cut in half along each axial direction.

FIG. 9A is a view showing outer shapes of elbow materials cut in half along each axial direction. In FIG. 9A the outer shape at the most left is circular, and the outer shape at the next position is hexagonal, and the outer shape at further next position is octagonal, and the outer shape at the most right is combination of partially circular and a pair of parallel planes, respectively.

Figure 9B:
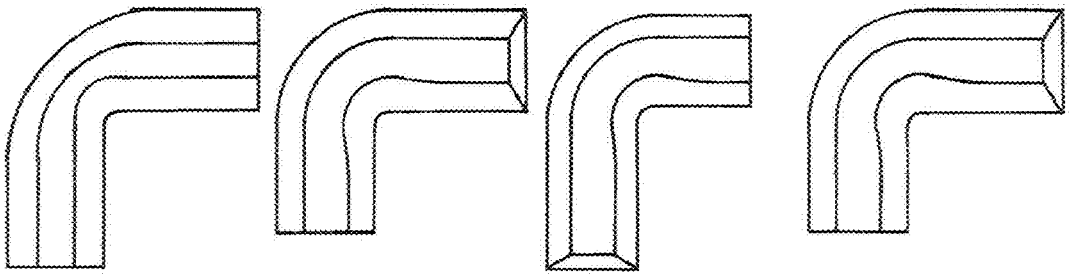
FIG. 9B is a view showing inside shapes of the elbow materials cut in half in FIG. 9A.

FIG. 9B is a view showing inside shapes of the elbow materials cut in half in FIG. 9A.

In FIG. 9B the hollow passage in the bent portion of the elbow material with the circular outer shape at the most left is narrower than those of other three elbow materials at the right side thereof.

Figure 10A:
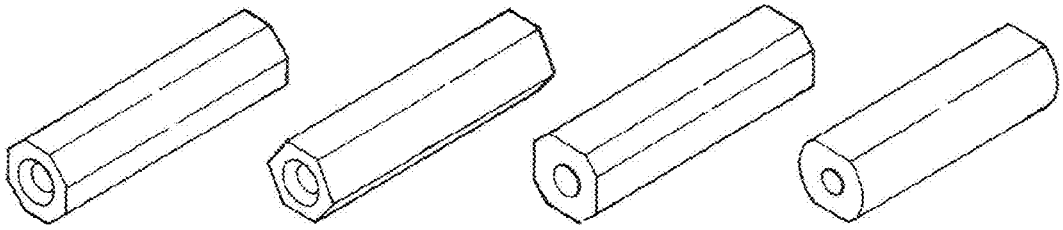
FIG. 10A is a view showing metal hollow thick walled members having at least one pair of parallel surfaces in the periphery.
Figure 1:
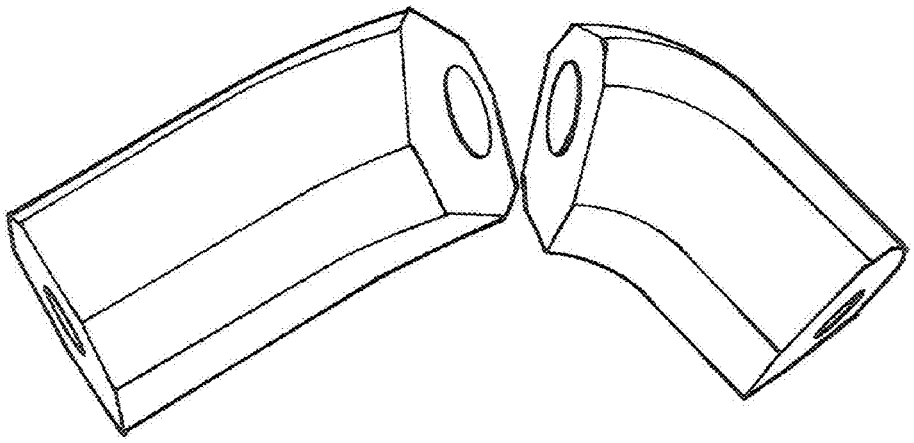

FIG. 10A is a view showing metal hollow thick walled members having at least one pair of parallel surfaces in the periphery. In FIG. 10A the outer shapes of the elbow materials from the most left to the most right are approximately regular octagon, regular hexagon, regular square and a pair of parallel surface at the top and the bottom.

Those are formed by performing the milling operation of a thick walled tube like member having a circular circumference in the periphery with a given thickness and a given length by means of the cold work such as the deep drawing processing from a steel wire rod in solid core.

FIG. 10B is a view showing a process for forming a thick walled tube like member with a circular outer shape and a predetermined length having a given thick wall made by cutting a steel wire rod in solid core to a given length and then by processing in the deep drawing.

In FIG. 10B the left figure shows a member having hollow circular passage in the central portion along the axis formed after cutting a steel wire rod in solid core to a predetermined length, and the right figure shows a metal hollow thick walled member with the circumference round before milling operation, and the central figure shows a state on the way of processing in which the member of the right figure is formed by the cold work continuously, and shows that there remains a large portion in diameter at the one end portion corresponding to the metal hollow thick walled member in the right figure. In addition, it is possible to directly form the metal hollow thick walled members having at least one pair of parallel surfaces in the periphery as shown in FIG. 10A without the milling operation through making another die for polygonal outer shapes.

FIG. 11A is a view of an elbow material with the periphery approximately shaped in a square and with two pieces separated by cutting at the bend portion.

FIG. 11B is a sectional view of pieces of the elbow material in FIG. 11A seen from above. In FIG. 11B it is shown that there is little deformation from circular to elliptic in the hollow central hole at the bent portion.

Figure 12A:
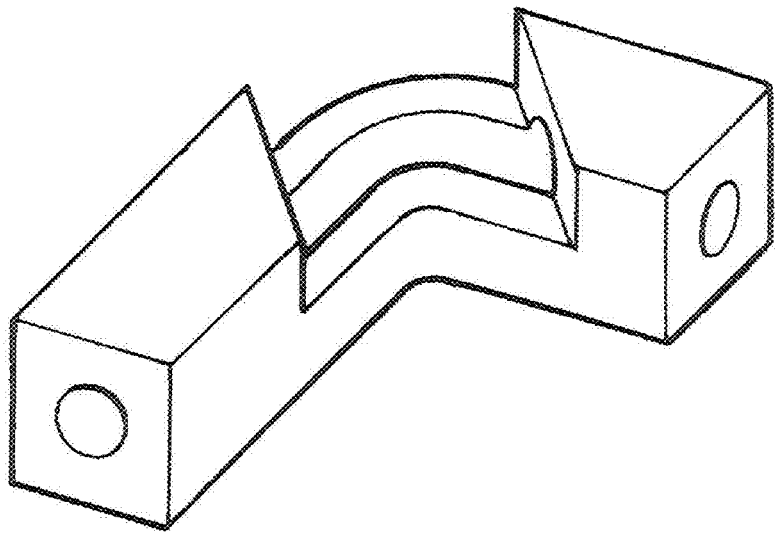
FIG. 12A is a view of an elbow material with the periphery shaped in the square and the bent portion partially cut along the axis direction.

FIG. 12A is a view of an elbow material with the periphery shaped in the square and the bent portion partially cut along the axis direction.

FIG. 12B is a sectional view of the elbow material in FIG. 12A seen from above. In FIG. 12B it is shown that the hollow passage is small in deformation toward inside, compared with the most left half member in FIG. 9B.

FIG. 13A is a perspective view of an elbow material with the periphery approximately shaped in the hexagonal. In addition in the milling operation before bending formation, the periphery is not machined as the complete regular hexagonal and each edge line does not cross, as shown in the member PM in FIG. 8.

Figure 13B:
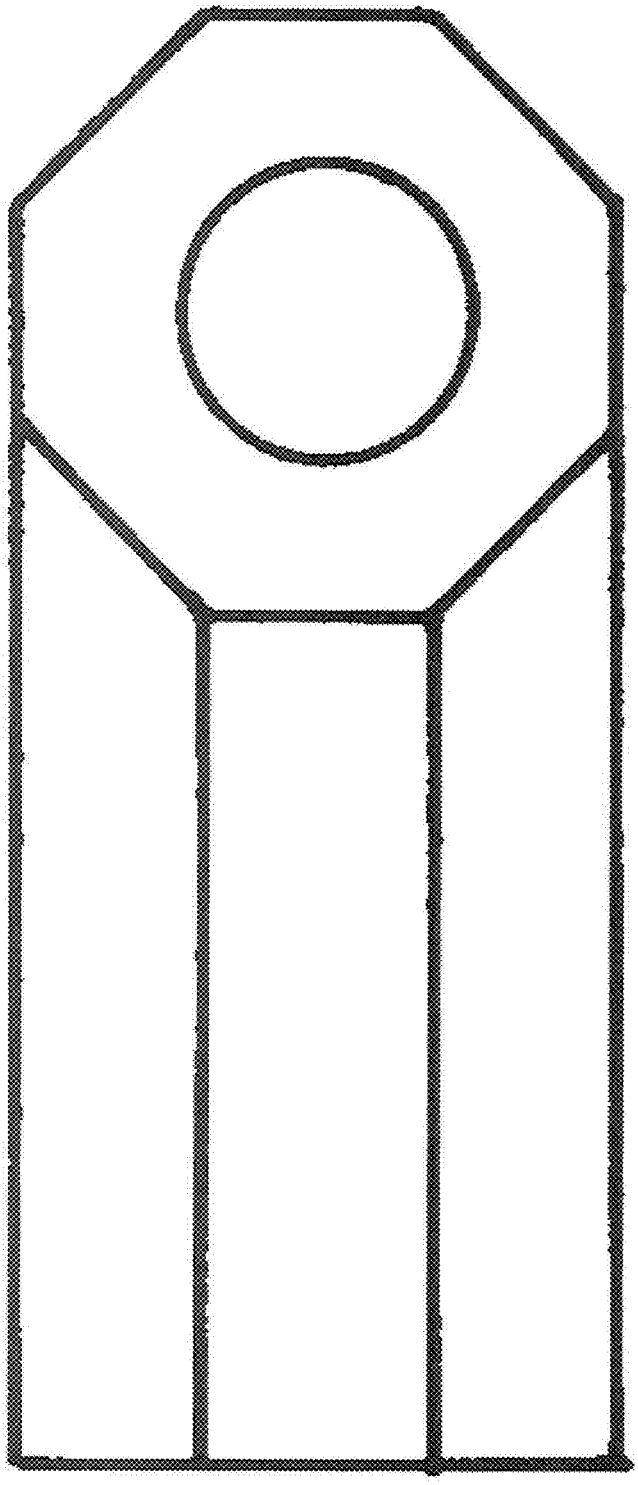
FIG. 13B is a sectional view of the bend portion of the elbow material in FIG. 13A seen from above.
Figure 1:
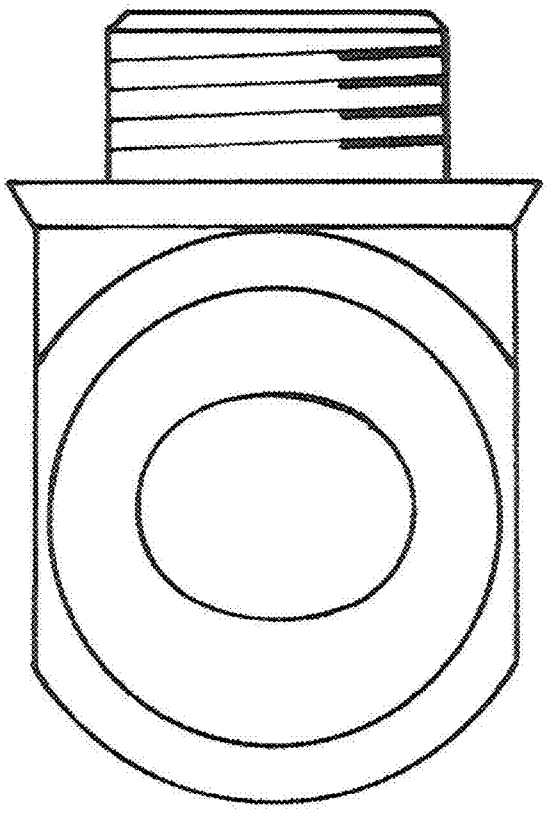

FIG. 13B is a sectional view sectioned at the bent portion of the elbow material in FIG. 13A seen from above. In the case, also it is observed that there is little deformation to inside in the sectional shape of the hollow hole at the bent portion.

FIG. 14 shows a deformed hollow hole seen from one end of an elbow product with a screw machined from the elbow material with the circular periphery.

In FIG. 14 the hollow hole at the central portion is an elliptic like shape with the upper portion deformed to inside at the bent portion in the hole and this deformation extends to the end face of the elbow.

The preferred embodiment of the present invention has now been explained referring to the drawings. However, the present invention is not restricted to the illustrated contents of the embodiments. A person ordinary skill in the art could modify variously based on the embodiment.

For example, it is possible to electrically detect and perform the position and pressing force of the upper die through employing the electric servo system, instead of the ram cylinder constituting the first moving means. Similarly, it is possible to electrically detect and perform the position and pressing force of the center pin through employing the electric servo system, instead of the hydraulic cylinder constituting the second moving means.

Also, it is possible to perform a rolling system by means of mounting a bearing device on the one side of the guide member, though in the embodiment of the present invention a sliding system is employed wherein the center pin and through pins can slide on the first and second guide members.

Further, it is possible to constitute so that the pressing forces can be supplied from both side faces of the metal hollow thick walled member, though in the embodiment of the present invention the hydraulic cylinder unit is provided on one side so that only one side face of the member is pressed through the pressing piece.

Further, also, in the embodiments shown in FIGS. 4A, 4B, and 7 there is provided with stopper members so that a final stage of the deformation to the metal hollow thick walled member is performed by increasing the back pressure in the ram cylinder during the time t3 to t4. Instead of using the stopper members, it is possible to form the elbow material by holding the upper die at the predetermined position using the hydraulic cylinder as the second moving means and by making external force necessary for the plastic deformation to be small through appropriately setting the heating temperature of the metal hollow thick walled member.

What is claimed is

1. An elbow material production device, the elbow material formed by bending to a predetermined angle a metal hollow thick walled member of a given length having a hollow passage of an approximately circular section along an axial direction of the member with ends of the member being open and a periphery of the member being approximately circular or having at least one pair of parallel surfaces, the device comprising:

a toggle type link mechanism including a first guide member with a first guide groove, a center pin, a pair of guide plates and a second guide member with a second guide groove, the first guide groove movably guiding the center pin in a first direction perpendicular to an axial direction of the center pin, one end of each of the guide plates being pivotally connected to the center pin, and the second guide groove movably guiding another end of each of the guide plates in a second direction perpendicular to the axial direction of the center pin;

two half dies forming a first side die arrangement, the two half dies contacting approximately half of a surface region in the longitudinal direction of the hollow thick walled member to be deformed;

first side die arrangement holding members, one for fixedly holding each of the half dies of the first side die arrangement, respectively, one of the holding members being fixedly connected to a lateral surface of each of the guide plates, respectively;

a second side die arrangement having a first contact surface and a second contact surface, the first contact surface contacting another portion of the surface of the hollow thick walled member when the member is bent to a predetermined angle, and the second contact surface having a central portion which contacts an outer surface portion of the center pin so as to press the center pin in the first direction;

a second side die arrangement holding member for fixedly holding the second side die arrangement;

a first mechanism which moves the second side die arrangement holding member in the first direction; and a second mechanism which moves the center pin in the first direction along the first guide groove through contacting the one end portion of the guide plates pivotally connected to the center pin.

2. The elbow material production device according to claim 1, further comprising:

a stopper member which contacts the outer surface of the first side die arrangement holding members, the stopper member being located corresponding to the position of the center pin at which the hollow thick walled member has been bent to the predetermined angle.

3. The elbow material production device according to claim 1 or 2 wherein the first side die arrangement is provided with position limiting means for limiting the final side positions of the hollow thick walled member.

4. The elbow material production device according to claim 3 wherein the position limiting means includes a position adjustable member which contacts the side of the hollow thick walled member.

5. The elbow material production device according to any one of claims 1 or 2 wherein the elbow material is circular in the periphery, and wherein the center pin advances and retracts in the axial direction of the center pin in accordance with the movement in the first direction, and an end of the center pin contacts and presses a lateral surface of the hollow thick walled member.

6. The elbow material production device according to any one of claims 1 or 2 wherein the elbow material is polygonal in the periphery, and wherein the center pin contacts a pair of parallel surfaces of the hollow thick walled member and holds the hollow thick walled member from movement in the axial direction.

7. The elbow material production device according to any one of claims 1 or 2 further comprising:

a base plate;

a plurality of side wall plates; and a plurality of outer side wall plates, the side wall plates and the outer side wall plates defining a space, the toggle type link mechanism, the first side die arrangement, and the first side die arrangement holding members being disposed in the space.

8. An elbow material production method, the elbow material formed by bending to a predetermined angle a metal hollow thick walled member of a given length having a hollow passage of an approximately circular section along an axial direction of the member with ends of the member being open, and a periphery of the member being approximately circular or having at least one pair of parallel surfaces, the method using a bending apparatus comprising:

a toggle type link mechanism including a first guide member with a first guide groove, a center pin, a pair of guide plates and a second guide member with a second guide groove, the first guide groove movably guiding the center pin in a first direction perpendicular to an axial direction of the center pin, one end of each of the guide plates being pivotally connected to the center pin, and the second guide groove movably guiding another end of each of the guide plates in a second direction perpendicular to the axial direction of the center pin;

two half dies forming a first side die arrangement formed so as to contact approximately half of a surface region in the longitudinal direction of the hollow thick walled member to be formed;

first side die arrangement holding members, one for fixedly holding each of the half dies of the first side die arrangement, respectively, one of the holding members being fixedly connected to a lateral surface of each of the guide plates, respectively;

a second side die arrangement having a first contact surface and a second contact surface, the first contact surface contacting another portion of the surface of the hollow thick walled member when the member is bent to a predetermined angle, and the second contact surface having a central portion which contacts an outer surface portion of the center pin so as to press center pin in the first direction;

a second side die arrangement holding member for fixedly holding the second side die arrangement;

a first mechanism which moves the second side die arrangement holding member in the first direction, a second mechanism which moves the center pin in the first direction along the first guide groove through contacting the one end portion of the guide plates pivotally connected to the center pin;

the method comprising:

arranging the two half dies on the same line by driving the second mechanism;

locating the hollow thick walled member, heated in advance to the temperature capable of plastic deformation, to the predetermined position of the half dies after the arranging;

contacting the second contact surface formed in the second side die arrangement with an outer surface portion of the center pin by driving the first mechanism and moving the second side die arrangement holding member to the hollow thick walled member;

moving the center pin with a first pressing force in the first direction by further driving the first mechanism after the contacting and causing the two half dies to depart from and slope toward each other in accordance with the movement, and as the result bending the hollow thick walled member;

allowing the center pin to move in the first direction during the center pin moving, the second mechanism applying a second pressing force through the one end of each of the guide plates to the center pin, the second pressing force being smaller than the first pressing force and with the direction opposite to the first pressing force;

holding the second side die arrangement at a predetermined position in the first direction during a predetermined time interval using the first mechanism, the predetermined position corresponding to the state in which the hollow thick walled member has been bent to a predetermined angle by the contacting and the center pin moving;

separating the second side die arrangement from the hollow thick walled member bent to the predetermined angle by moving the second side die arrangement holding member in the direction opposite to the direction in the contacting using the first mechanism after the holding;

returning the center pin in the first direction so that the two half dies are arranged on the same line as the initial state by driving the second mechanism after starting the separating.

9. The elbow material production method according to claim 8 wherein the bending apparatus further comprises a stopper member which contacts the outer surface of the first side die arrangement holding members, the stopper member being located corresponding to the position of the center pin at which the hollow thick walled member has been bent to the predetermined angle, and wherein the stopper member receives the first pressing force acting on the center pin during the holding.

10. The elbow material production method according to claim 8 or 9 wherein each of the half dies is provided with position limiting means for limiting the final side positions of the hollow thick walled member.

11. The elbow material production method according to claim 10 wherein at least one of the position limiting means includes a position adjustable member which contacts the side of the hollow thick walled member.

12. The elbow material production method according to any one of claims 8 or 9 wherein said elbow material is circular in the periphery, and wherein the center pin advances and retracts in the axial direction of the center pin in accordance with the movement in the first direction during the center pin moving, and an end of the center pin contacts and presses a lateral surface of the hollow thick walled member.

13. The elbow material production method according to any one of claims 8 or 9 wherein said elbow material is polygonal in the periphery, and wherein the center pin contacts a pair of parallel surfaces of the hollow thick walled member and holds the hollow thick walled member from movement in the axial direction during the center pin moving.

* * * * *

UNITED STATES PATENT AND TRADEMARK OFFICE

CERTIFICATE OF CORRECTION

PATENT NO. : 8,387,435 B2
APPLICATION NO. : 12/517881
DATED : March 5, 2013
INVENTOR(S) : Bandou et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 941 days.

Signed and Sealed this
First Day of September, 2015

Michelle K. Lee

Michelle K. Lee
*Director of the United States Patent and Trademark Office*